US007978157B2

(12) United States Patent
Seo et al.

(10) Patent No.: US 7,978,157 B2
(45) Date of Patent: Jul. 12, 2011

(54) ELECTRO-LUMINESCENCE DISPLAY

(75) Inventors: Jung Min Seo, Daegu (KR); Hyun Joung Kim, Daegu (KR); Won Kyu Ha, Gyeongsangbuk-do (KR); Hak Su Kim, Seoul (KR); Guen Bae Park, Gyeongsangnam-do (KR); Eun Myung Park, Daegu (KR); Kee Mog Shin, Daegu (KR)

(73) Assignee: LG Display Co., Ltd., Seoul (KR)

( * ) Notice: Subject to any disclaimer, the term of this patent is extended or adjusted under 35 U.S.C. 154(b) by 377 days.

(21) Appl. No.: 12/398,809

(22) Filed: Mar. 5, 2009

(65) Prior Publication Data

US 2009/0167650 A1 Jul. 2, 2009

Related U.S. Application Data

(62) Division of application No. 11/049,058, filed on Feb. 3, 2005, now Pat. No. 7,511,688.

(30) Foreign Application Priority Data

Feb. 4, 2004 (KR) ..... P2004-07244
Feb. 4, 2004 (KR) ..... P2004-07247
Feb. 4, 2004 (KR) ..... P2004-07248
Feb. 4, 2004 (KR) ..... P2004-07249

(51) Int. Cl.
*G09G 3/30* (2006.01)

(52) U.S. Cl. ..... 345/76; 345/39; 345/55; 345/204

(58) Field of Classification Search ..... 345/76, 345/39, 55, 204
See application file for complete search history.

(56) References Cited

U.S. PATENT DOCUMENTS

| | | | |
|---|---|---|---|
| 3,997,892 | A | 12/1976 | Susset |
| 6,225,931 | B1 | 5/2001 | Rao et al. |
| 6,603,071 | B2 | 8/2003 | Takao |
| 2002/0060525 | A1 | 5/2002 | Sagano et al. |
| 2002/0075208 | A1 | 6/2002 | Bae et al. |
| 2003/0142363 | A1 | 7/2003 | Oota |

FOREIGN PATENT DOCUMENTS

| | | | |
|---|---|---|---|
| JP | 2002041004 | A | 2/2002 |
| JP | 2002366112 | A | 12/2002 |
| JP | 2003255900 | A | 9/2003 |
| JP | 2004354625 | A | 12/2004 |
| KR | 10 2002-0009866 | | 2/2002 |
| KR | 10-2004-0051476 | A | 6/2004 |
| KR | 10-2004-0061899 | A | 7/2004 |

OTHER PUBLICATIONS

Japanese Office Action dated Dec. 14, 2010 corresponding to Japanese Application No. JP2005-029381.

*Primary Examiner* — Richard Hjerpe
*Assistant Examiner* — Leonid Shapiro
(74) *Attorney, Agent, or Firm* — Birch, Stewart, Kolasch & Birch, LLP

(57) ABSTRACT

An electro-luminescence display device including red, green and blue reference gamma generators each having three digital analog converters or more in order to generate a reference gamma voltage of low gray level and a reference gamma voltage of high gray level, and at least one integrated circuit to generate a data signal in use of the reference gamma voltage of low gray level and the reference gamma voltage of high gray level. Each reference gamma generator includes a first digital analog converter to divide a voltage supplied to itself in order to generate i numbers of voltage levels, a second digital analog converter to divide a voltage supplied to itself in order to generate j numbers of voltage levels, and a third digital analog converter to receive two voltage levels from the second digital analog converter and to divides the two received voltage levels into j numbers of voltage levels.

13 Claims, 34 Drawing Sheets

ELECTRO-LUMINESCENCE DISPLAY

This application is a divisional of U.S. application Ser. No. 11/049,058, filed on Feb. 3, 2005, now U.S. Pat. No. 7,511,688 which claims the benefit of the Korean Patent Application Nos. P2004-07244, P2004-07247, P2004-07248, and P2004-07249 filed on Feb. 4, 2004. All of these applications are hereby incorporated by reference.

BACKGROUND OF THE INVENTION

1. Field of the Invention

The present invention relates to an electro-luminescence display, and more particularly to an electro-luminescence display that is adaptive for reducing its manufacturing cost as well as reducing its process time.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc.

The EL display in such display devices is a self-luminous device capable of light-emitting a phosphorous material by a re-combination of electrons with holes. The EL display device is generally classified into an inorganic EL device using the phosphorous material as an inorganic compound and an organic using it as an organic compound. Such an EL display device has an advantage the its response speed is as fast as the cathode ray tube CRT when compared with a passive luminous device that requires a separate light source like that liquid crystal display. The EL display device also has many advantages of a low voltage driving, a self-luminescence, a thin-thickness, a wide viewing angle, a fast response speed and a high contrast, etc. such that it can be highlighted into a post-generation display device.

FIG. 1 is a sectional diagram illustrating a general organic EL structure for explanation of light emission principle of an EL display device. The organic EL includes an electron injection layer 4, an electron carrier layer 6, a light-emitting layer 8, a hole carrier layer 10, a hole injection layer 12 between a cathode 2 and an anode 14.

When a voltage is applied between the anode 14 of a transparent electrode and the cathode 2 of a metal electrode, an electron generated from the cathode 2 moves to the light-emitting layer 8 through the electron injection layer 4 and the electron carrier layer 6. Also, a hole generated from the anode 14 moves to the light-emitting layer 8 through the hole injection layer 12 and the hole carrier layer 10. Accordingly, the electrons are collided with the holes at the light-emitting layer 8, wherein the electrons and the holes are supplied from the electron carrier layer 6 and the hole carrier layer 10, and the electrons and the holes are recombined to generate light. The generated light is emitted through the anode 14 to display a picture. The light-emission brightness of the EL organic device is not proportional to the voltage flowing in both ends of the device, but it is proportional to a supply current, thus the anode 14 is usually connected to a static current source.

FIG. 2A is a diagram illustrating a general EL display device.

Referring to FIG. 2A, an EL display device includes an EL display panel 20 having EL cells 28 arranged at each intersection of scan electrode lines SL and data electrode lines DL, a scan driver 22 to drive the scan electrode lines SL, a data driver 24 to drive the data electrode lines DL, and a gamma voltage supplier 26 to supply reference gamma voltages to the data driver 24.

Each of the EL cells 28 is selected when a scan pulse is applied to the scan electrode line SL, which is a cathode, to generate a light corresponding to a pixel signal, i.e., data signal or current signal, supplied to the data electrode line DL, which is an anode. Each of the EL cells 28 operates substantially in the same manner as a diode connected between the data electrode line DL and the scan electrode line SL to be equivalent. Accordingly, each of the EL cells 28 supplies a negative scan pulse to the scan electrode line SL, and at the same time applies a positive current according to a data signal to the data electrode line DL, thereby emitting light when a forward voltage is applied. Differently from this, the EL cells 28 included in the unselected scan line do not emit light due to a reverse bias voltage.

The scan driver 22 sequentially supplies the negative scan pulse to a plurality of scan electrode lines SL.

The data driver 24 includes more than one data integrated circuit 30. As the EL display panel 20 becomes bigger, the number of data integrated circuits 30, which form the data driver 24, is larger. On the other hand, the data driver 24 might be composed of one data integrated circuit 30 as in FIG. 2B when the EL display panel 20 is made in a small panel like the display panel of a mobile phone.

In this way, the conventional EL display device supplies the current signal, which is proportional to an input data, to each of the EL cells 28 to make the EL cells 28 emit light, thereby displaying a picture. EL cells 28 is composed of an R cell having a red (hereinafter, "R") phosphorus, a G cell having a green (hereinafter, "G") phosphorus, and a B cell having a blue (hereinafter, "B") phosphorus, for materializing color.

Each of R, G, B phosphorus's has different efficiency from each other. In other words, the brightness level of R, G, B cells are different from each other in case that data signals of same level to R, G, B cells. Accordingly, the gamma voltages are set differently from each other by R, G, B in comparison with the same brightness in order to meet white balance. The gamma voltage supplier 26 generates a different reference gamma voltage by R, G, B.

FIG. 3 is a circuit diagram illustrating in detail a gamma voltage supplier 26 shown in FIGS. 2A and 2B.

Referring to FIG. 3, the prior art gamma voltage supplier 26 includes an R gamma voltage supplier 32, a G gamma voltage supplier 34, a B gamma voltage supplier 36 for supplying each of the different reference gamma voltages by R, G, B.

The R gamma voltage supplier 32 includes a divided voltage resistors r_R1, r_R2, r_R3 connected in series between a supply voltage source VDD and a ground voltage source GND. A divided voltage generated at nodes n1, n2 between the divided voltage resistors r_R1, r_R2, r_R3 is supplied to the data driver 24 as a reference gamma voltage. The voltage of the first node n1 is used as an R reference gamma voltage VH_R of low gray level, and the voltage of the second node n2 is used as an R reference gamma voltage VL_R of high gray level.

The G gamma voltage supplier 34 includes a divided voltage resistors r_G1, r_G2, r_G3 connected in series between a supply voltage source VDD and a ground voltage source GND. A divided voltage generated at nodes n3, n4 between the divided voltage resistors r_G1, r_G2, r_G3 is supplied to the data driver 24 as a reference gamma voltage. The voltage of the third node n3 is used as a G reference gamma voltage VH_G of low gray level, and the voltage of the fourth node n4 is used as a G reference gamma voltage VL_G of high gray level.

The B gamma voltage supplier 36 includes a divided voltage resistors r_B1, r_B2, r_B3 connected in series between a supply voltage source VDD and a ground voltage source GND. A divided voltage generated at nodes n5, n6 between the divided voltage resistors r_B1, r_B2, r_B3 is supplied to the data driver 24 as a reference gamma voltage. The voltage of the fifth node n5 is used as a G reference gamma voltage VH_B of low gray level, and the voltage of the sixth node n6 is used as a G reference gamma voltage VL_B of high gray level.

In other words, the prior art gamma voltage supplier 26 differently supplies the reference gamma voltage, which corresponds to each of the R cell, the G cell and the B cell, to the data driver 24. On the other hand, the gamma voltage supplier 26 includes a plurality of the R gamma voltage supplier 32, the G gamma voltage supplier 34, and the B gamma voltage supplier 36, as in FIG. 3, so that a light of different brightness could be generated in correspondence to an external environment. For example, the gamma voltage supplier 26 can includes three each of the R gamma voltage supplier 32, the G gamma voltage supplier 34, and the B gamma voltage supplier 36 so that three modes of reference gamma voltage could be supplied in correspondence to night, day and the external environment. In this case, the number of total resistors included in the gamma voltage supplier 26 has to increase to 27.

The data integrated circuit 30 divides voltage as much as the gray levels, which are capable of expressing the reference gamma voltage supplied from the gamma voltage supplier 26, to generate an analog data which corresponds to each gray level. For this, the data integrated circuit 30 includes a shift register 40, a first latch array 42, a second latch array 44, a digital analog converter (hereinafter, referred to as "DAC"), and an output array 48.

The shift register 40 generates a sampling signal to sample data while shifting a start pulse in accordance with a shift clock.

The first latch array 42 includes a first R latch part 42*a*, a first G latch part 42*b* and a first B latch part 42C. The first R latch part 42*a* samples an R data in accordance with the sampling signal supplied from the shift register 40 and temporarily stores the R data. The first G latch part 42*b* samples a G data in accordance with the sampling signal supplied from the shift register 40 and temporarily stores the G data. The first B latch part 42C samples a B data in accordance with the sampling signal supplied from the shift register 40 and temporarily stores the B data.

The second latch array 44 supplies the data from the first latch array 42 to the DAC 46 in response to an output enable signal. For this, the second latch array 44 includes a second R latch part 44*a*, a second G latch part 44*b* and a second B latch part 44C. The second R latch part 44*a* supplies the data from the first R latch part 42*a* to the DAC 46 in response to the output enable signal. The second G latch part 44*b* supplies the data from the first G latch part 42*b* to the DAC 46 in response to the output enable signal. The second B latch part 44*c* supplies the data from the first B latch part 42*c* to the DAC 46 in response to the output enable signal.

The DAC 46 converts the data from the second latch array 44 into the analog data and outputs the converted data to the output array 48 in use of the reference gamma voltage VH_R, VL_R, VH_G, VL_G, VH_B, VL_B. For this, the DAC 46 includes an R DAC 46*a*, a G DAC 46*b* and a B DAC 46*c*.

The R DAC 46*a* receives the R reference gamma voltage VH_R of low gray level and the R reference gamma voltage VL_R of high gray level from the gamma voltage supplier 26. And the R DAC 46*a* generates a plurality of gamma voltages in use of the R reference gamma voltage VH_R of low gray level and the R reference gamma voltage VL_R of high gray level. For example, the R DAC 46*a* generates sixty four analog gamma voltages assuming that there is a six bit input data. And the R DAC 46*a* selects the analog gamma voltage corresponding to the digital data from the second R latch part 44*a* as the analog data which is to be supplied to the data line DL.

The G DAC 46*b* receives the G reference gamma voltage VH_G of low gray level and the G reference gamma voltage VL_G of high gray level from the gamma voltage supplier 26. And the G DAC 46*b* generates a plurality of gamma voltages in use of the G reference gamma voltage VH_G of low gray level and the G reference gamma voltage VL_G of high gray level. For example, the G DAC 46*b* generates sixty four analog gamma voltages assuming that there is a six bit input data. And the G DAC 46*b* selects the analog gamma voltage corresponding to the digital data from the second G latch part 44*b* as the analog data which is to be supplied to the data line DL.

The B DAC 46*c* receives the B reference gamma voltage VH_B of low gray level and the B reference gamma voltage VL_B of high gray level from the gamma voltage supplier 26. And the B DAC 46C generates a plurality of gamma voltages in use of the B reference gamma voltage VH_B of low gray level and the B reference gamma voltage VL_B of high gray level. For example, the B DAC 46*c* generates sixty four analog gamma voltages assuming that there is a six bit input data. And the B DAC 46*c* selects the analog gamma voltage corresponding to the digital data from the second B latch part 44*c* as the analog data which is to be supplied to the data line DL.

The output array 48 supplies the analog data supplied from the DAC 46 to the data electrode lines DL. For this, the output array 48 includes a first output part 48*a*, a second output part 48*b*, a third output part 48*c*. A first output part 48*a* supplies the analog data from the R DAC 46*a* to the data electrode lines DL which is for supplying data to the R cells. The second output part 48*b* supplies the analog data from the G DAC 46*b* to the data electrode lines DL which is for supplying data to the G cells. The third output part 48*c* supplies the analog data from the B DAC 46*c* to the data electrode lines DL which is for supplying data to the B cells.

As a result, the gamma voltage supplier 26 supplies the reference gamma voltages, which corresponds to the R cell, the G cell and the B cell and are different from each other, to the data driver 24, and the data driver 24 generates the data signal, which is to be supplied to the R cell, the G cell and the B cell in use of the different reference gamma voltage.

And yet, the related art EL display device might have the brightness deviation generated between the EL display panels 20 by the deviation of manufacturing process. In other words, the brightness might be different in the same data in accordance with the EL display panel 20. In order to reduce such a brightness deviation, in the prior art, the resistance value of the resistors included in the gamma voltage supplier 26 is controlled to reduce the brightness deviation between the EL display panels 20. However, if the brightness deviation is compensated with the resistance value of the resistors, its process time is lengthened due to the adjustment time required for optimization of the resistance value or the replacement time of the resist, thus it is impossible to compensate the exact brightness deviation only by the adjustment of the resistance value.

The data integrated circuit 30 is mounted on a chip on film COF 50 as in FIG. 5, the resistors of the gamma voltage supplier 26 are mounted on a flexible printed circuit FPC 52 due to many resistors, which is difficult to be mounted on the COF 50. Because of many resistors of the gamma voltage supplier 26 like this, it is difficult to secure a margin in designing the FPC. Terminals of one side of the FPC 52 are connected to the COF 50 and terminals of the other side are connected to a printed circuit board PCB (not shown). Due to such FPC 52 and COF 50, there is a problem that the prior art EL display device has high manufacturing cost due to the FPC 52, and time is required for aligning the FPC 52 with the COF 50.

SUMMARY OF THE INVENTION

Accordingly, it is an object of the present invention to provide an electro-luminescence display that is adaptive for reducing its manufacturing cost as well as reducing its process time.

In order to achieve these and other objects of the invention, an electro-luminescence display device according to an aspect of the present invention includes a gamma generator to output a reference gamma voltage corresponding to a control data supplied from the outside; and at least one data integrated circuit to receive a data from the outside and to generate a data signal corresponding to the bit number of the data in use of the reference gamma voltage.

The gamma generator may include: a red gamma part to generate a red reference gamma voltage so that the data signal to be supplied to a red cell can be generated; a green gamma part to generate a green reference gamma voltage so that the data signal to be supplied to a green cell can be generated; and a blue gamma part to generate a blue reference gamma voltage so that the data signal to be supplied to a blue cell can be generated.

Each of the red gamma part, the green gamma part and the blue gamma part may include: a first resist part and a second resist part to divide the voltage of a supply voltage source; a first analog digital converter to divide the divided voltage supplied from the first resist part into a plurality of voltage levels; a second analog digital converter to divide the divided voltage supplied from the second resist part into a plurality of voltage levels; and a register to supply a first control data so that any one voltage can be outputted in the first analog digital converter, as well as to supply a second control data to that any one voltage can be outputted in the second analog digital converter.

Each of the first and second resist parts may include three resistors so that the voltage of the supply voltage source can be divided into two voltage values.

Bit values of the first and second control data may be set to enable the electro-luminescence display device to display uniform brightness.

The gamma generator and the data integrated circuits may be mounted on a chip-on-film COF.

The red reference gamma voltage, the green reference gamma voltage, the red reference gamma voltage may be set for a white balance to be balanced in red, green and blue cells.

The gamma generator may be integrated in the inside of the data integrated circuit.

An electro-luminescence display device according to another aspect of the present invention includes a gamma generation voltage supplier to generate a plurality of gamma generation voltages; a reference gamma generator to generate a plurality of reference gamma voltages in use of the gamma generation voltages; and at least one data integrated circuit to divide the reference gamma voltage into a plurality of voltage levels and to generate a data signal by selecting any one voltage level among the voltage levels in correspondence to a data from the outside.

The gamma generation voltage supplier may include: a red gamma generation voltage part to generate a red gamma generation voltage of high gray level and a red gamma generation voltage of low gray level; a green gamma generation voltage part to generate a green gamma generation voltage of high gray level and a green gamma generation voltage of low gray level; and a blue gamma generation voltage part to generate a blue gamma generation voltage of high gray level and a blue gamma generation voltage of low gray level.

Each of the red, green and blue gamma generation voltage parts may include: a first divided voltage resistor and a second divided voltage resistor installed between a supply voltage source and a ground voltage source in order to generate the gamma generation voltage of high gray level; and a third divided voltage resistor and a fourth divided voltage resistor installed between the supply voltage source and the ground voltage source in order to generate the gamma generation voltage of low gray level.

The reference gamma generator may include: a red reference gamma generator to generate a red reference gamma voltage of high gray level and a red reference gamma voltage of low gray level in use of the red gamma generation voltage of high gray level and the red gamma generation voltage of low gray level; a green reference gamma generator to generate a green reference gamma voltage of high gray level and a green reference gamma voltage of low gray level in use of the green gamma generation voltage of high gray level and the green gamma generation voltage of low gray level; and a blue reference gamma generator to generate a blue reference gamma voltage of high gray level and a blue reference gamma voltage of low gray level in use of the blue gamma generation voltage of high gray level and the blue gamma generation voltage of low gray level.

Each of the red, green and blue reference gamma generator may include: a first analog digital converter to receive a first reference voltage that has a higher voltage value than the gamma generation voltage of low gray level and the gamma generation voltage of low gray level, and to divide the received voltage into a plurality of first voltage levels; a second analog digital converter to receive a second reference voltage that has a lower voltage value than the gamma generation voltage of high gray level and the first reference voltage, and to divide the received voltage into a plurality of second voltage levels; and a register to supply a first control data so that any one voltage among the first voltage levels can be outputted in the first analog digital converter, as well as to supply a second control data to that any one voltage among the second voltage levels can be outputted in the second analog digital converter.

The number of the second voltage levels voltage-divided at the second analog digital converter may be set to be higher than the number of the first voltage levels voltage-divided at the first analog digital converter.

The first and second control data may be set to enable the electro-luminescence display devices to display uniform brightness.

The gamma generation voltage supplier may include: a red gamma generation voltage part to generate a red first reference voltage, a red gamma generation voltage of low gray level that has a lower voltage value than the red first reference voltage, a red second reference voltage that has a lower voltage value than the red first reference voltage, and a red gamma generation voltage of high gray level that has a lower voltage value than the red second reference voltage; a green gamma generation voltage part to generate a green first reference voltage, a green gamma generation voltage of low gray level that has a lower voltage value than the green first reference voltage, a green second reference voltage that has a lower voltage value than the green first reference voltage, and a green gamma generation voltage of high gray level that has a lower voltage value than the green second reference voltage; and a blue gamma generation voltage part to generate a blue first reference voltage, a blue gamma generation voltage of low gray level that has a lower voltage value than the blue first reference voltage, a blue second reference voltage that has a lower voltage value than the blue first reference voltage, and a blue gamma generation voltage of high gray level that has a lower voltage value than the blue second reference voltage.

Each of the red, green and blue gamma generation voltage parts may include: three first divided voltage resistors installed between a supply voltage source and a ground voltage source in order to generate the first reference voltage and the gamma generation voltage of low gray level; and three second divided voltage resistors installed between the supply voltage source and the ground voltage source in order to generate the second reference voltage and the gamma generation voltage of high gray level.

The reference gamma generator may include: a red reference gamma generator to generate a red reference gamma voltage of high gray level and a red reference gamma voltage of low gray level in use of the red first reference voltage, the red gamma generation voltage of low gray level, the red second reference voltage and the red gamma generation voltage of high gray level; a green reference gamma generator to generate a green reference gamma voltage of high gray level and a green reference gamma voltage of low gray level in use of the green first reference voltage, the green gamma generation voltage of low gray level, the green second reference voltage and the green gamma generation voltage of high gray level; and a blue reference gamma generator to generate a blue reference gamma voltage of high gray level and a blue reference gamma voltage of low gray level in use of the blue first reference voltage, the blue gamma generation voltage of low gray level, the blue second reference voltage and the blue gamma generation voltage of high gray level.

Each of the red, green and blue reference gamma generators may include: a first analog digital converter to divide the first reference voltage and the gamma generation voltage of low gray level into a plurality of first voltage levels; a second analog digital converter to divide the second reference voltage and the gamma generation voltage of high gray level into a plurality of second voltage levels; and a register to supply a first control data so that any one voltage among the first voltage levels can be outputted in the first analog digital converter, as well as to supply a second control data to that any one voltage among the second voltage levels can be outputted in the second analog digital converter.

The number of the second voltage levels voltage-divided at the second analog digital converter may be set to be higher than the number of the first voltage levels voltage-divided at the first analog digital converter.

The first and second control data may be set to enable the electro-luminescence display devices to display uniform brightness.

The reference gamma generator is integrated in the inside of the data integrated circuit.

An electro-luminescence display device according to still another aspect of the present invention may include: a red reference gamma generator, a green reference gamma generator and a blue reference gamma generator each having three digital analog converters or more in order to generate a reference gamma voltage of low gray level and a reference gamma voltage of high gray level; and at least one integrated circuit to generate a data signal in use of the reference gamma voltage of low gray level and the reference gamma voltage of high gray level.

Each of the red, green and blue reference gamma generators may include: a first digital analog converter to divide a voltage supplied to itself in order to generate i (i is a natural number) numbers of voltage levels; a second digital analog converter to divide a voltage supplied to itself in order to generate j (j is a smaller natural number than i) numbers of voltage levels; and a third digital analog converter to receive two voltage levels from the second digital analog converter and to divides the two received voltage levels into j numbers of voltage levels.

The first digital analog converter may select any one voltage among the i numbers of voltage levels, as the reference gamma voltage of low gray level, to supply the selected voltage to the integrated circuit.

The third digital analog converter may select any one voltage among the j numbers of voltage levels generated by itself, as the reference gamma voltage of high gray level, and to supply the selected voltage to the integrated circuit.

The second digital analog converter may supply two voltage levels adjacent to each other among the j numbers of voltage levels generated by itself, to the third digital analog converter.

Each of the red, green and blue reference gamma generation parts further may include a register storing control data's that control the output of the first digital analog converter, the second digital analog converter and the third digital analog converter.

The control data's stored at the register may be set to enable the electro-luminescence display devices to display uniform brightness.

The red reference gamma generator, the green reference gamma generator and the blue reference gamma generator may be mounted in the inside of the integrated circuit.

An electro-luminescence display device according to still another aspect of the present invention may include: a gamma generation voltage supplier to generate a reference gamma voltage of low gray level and a plurality of gamma generation voltages; a reference gamma generator to generate a reference gamma voltage of high gray level in use of the gamma generation voltages; and a data integrated circuit to generate a data signal in use of the reference gamma voltage of low gray level and the reference gamma voltage of high gray level.

The gamma generation voltage supplier may include: a red gamma generation voltage supplier to generate a red reference gamma voltage of low gray level so that the data signal to be supplied to a red cell can be generated; a green gamma generation voltage supplier to generate a green reference gamma voltage of low gray level so that the data signal to be supplied to a green cell can be generated; and a blue gamma generation voltage supplier to generate a blue reference gamma voltage of low gray level so that the data signal to be supplied to a blue cell can be generated.

Each of the red, green and blue gamma generation voltage supplier may include: a variable resistor to divide a voltage value of a common voltage source to generate the reference gamma voltage of low gray level; and a plurality of divided voltage resistors to divide the reference gamma voltage of low gray level into two different voltage levels from each other to generate the gamma generation voltages.

A resistance value of the variable resistor included in each of the red, green and blue gamma generation voltage supplier may be set to be differently.

The reference gamma generator may include: a red reference gamma generator to generate a red reference gamma voltage of high gray level so that the data signal to be supplied to a red cell can be generated; a green reference gamma generator to generate a green reference gamma voltage of high gray level so that the data signal to be supplied to a green cell can be generated; and a blue reference gamma generator to generate a blue reference gamma voltage of high gray level so that the data signal to be supplied to a blue cell can be generated.

Each of the red, green and blue reference gamma generators may include: a digital analog converter to divide the voltages supplied from the gamma generation voltage supplier into a plurality of voltage levels; and a register storing a control data that enables to output any one voltage among the voltage levels voltage-divided at the digital analog converter.

The control data stored at the register may be set to enable the electro-luminescence display device to display uniform brightness.

The reference gamma generator may be mounted in the inside of the data integrated circuit.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Hereinafter, the preferred embodiments of the present invention will be described in detail with reference to FIGS. 6 to 25.

Figure 6:
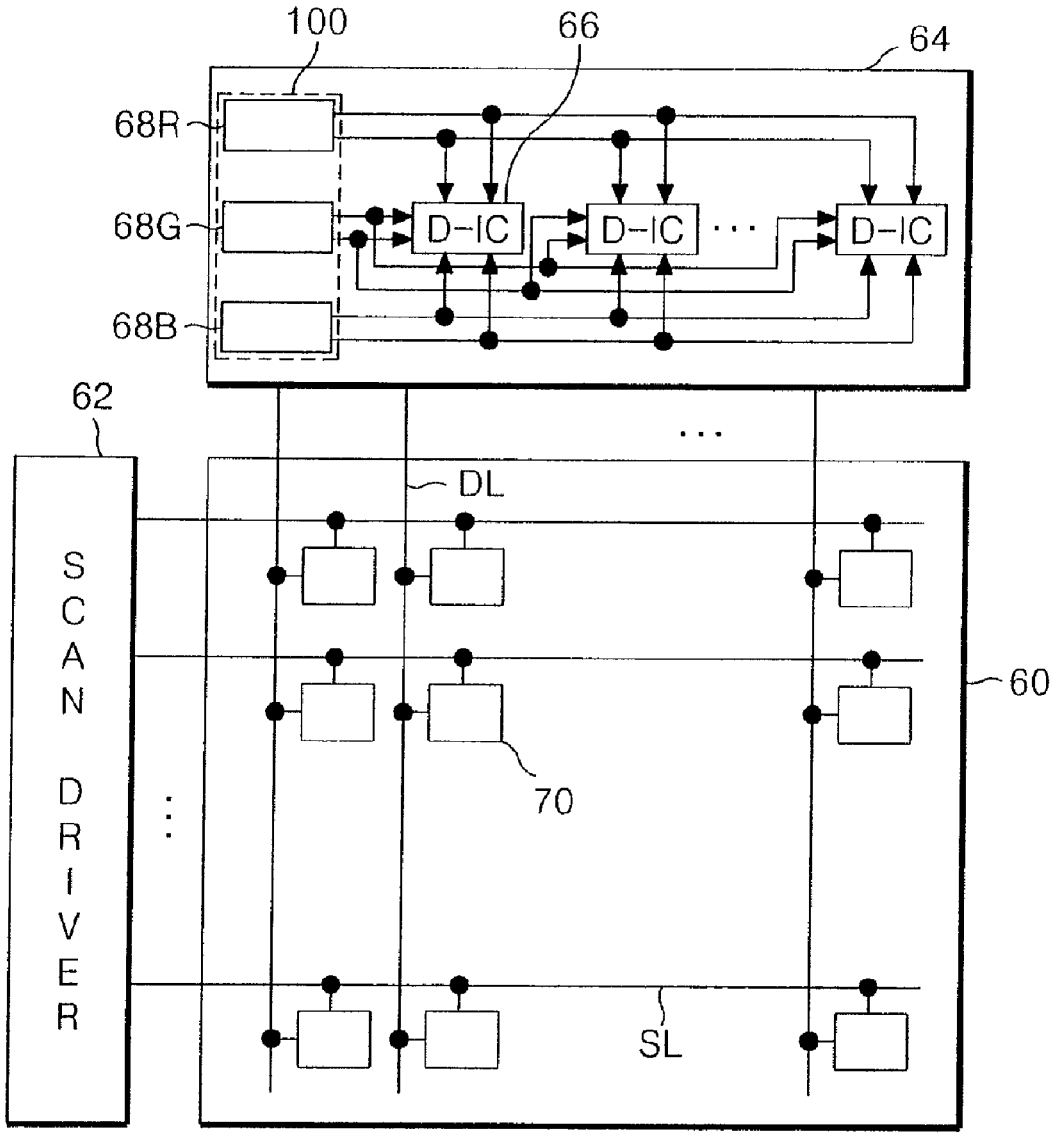
FIG. 6 is a diagram representing an electro-luminescence display device according to a first embodiment of the present invention.

FIG. 6 is a diagram illustrating an EL display device according to a first embodiment of the present invention. In the embodiment, it is assumed that at least two data integrated circuits 66 are mounted on a data driver 64.

Referring to FIG. 6, an EL display device according to a first embodiment of the present invention includes an EL display panel 60 having EL cells 70 arranged at each intersection of scan electrode lines SL and data electrode lines DL, a scan driver 62 to drive the scan electrode lines SL, and a data driver 64 to drive the data electrode lines DL.

Each of the EL cells 70 is selected when a scan pulse is applied to the scan electrode line SL to generate the light corresponding to a data signal supplied to the data electrode line DL. In other words, a designated picture is displayed at the EL display panel 60 because the light corresponding to the data signal is generated in each of the EL cells 70.

The scan driver 62 sequentially supplies a scan pulse to a plurality of scan electrode lines SL.

The data driver 64 includes a plurality of data integrated circuits 66 and a gamma generator 100.

Figure 4:
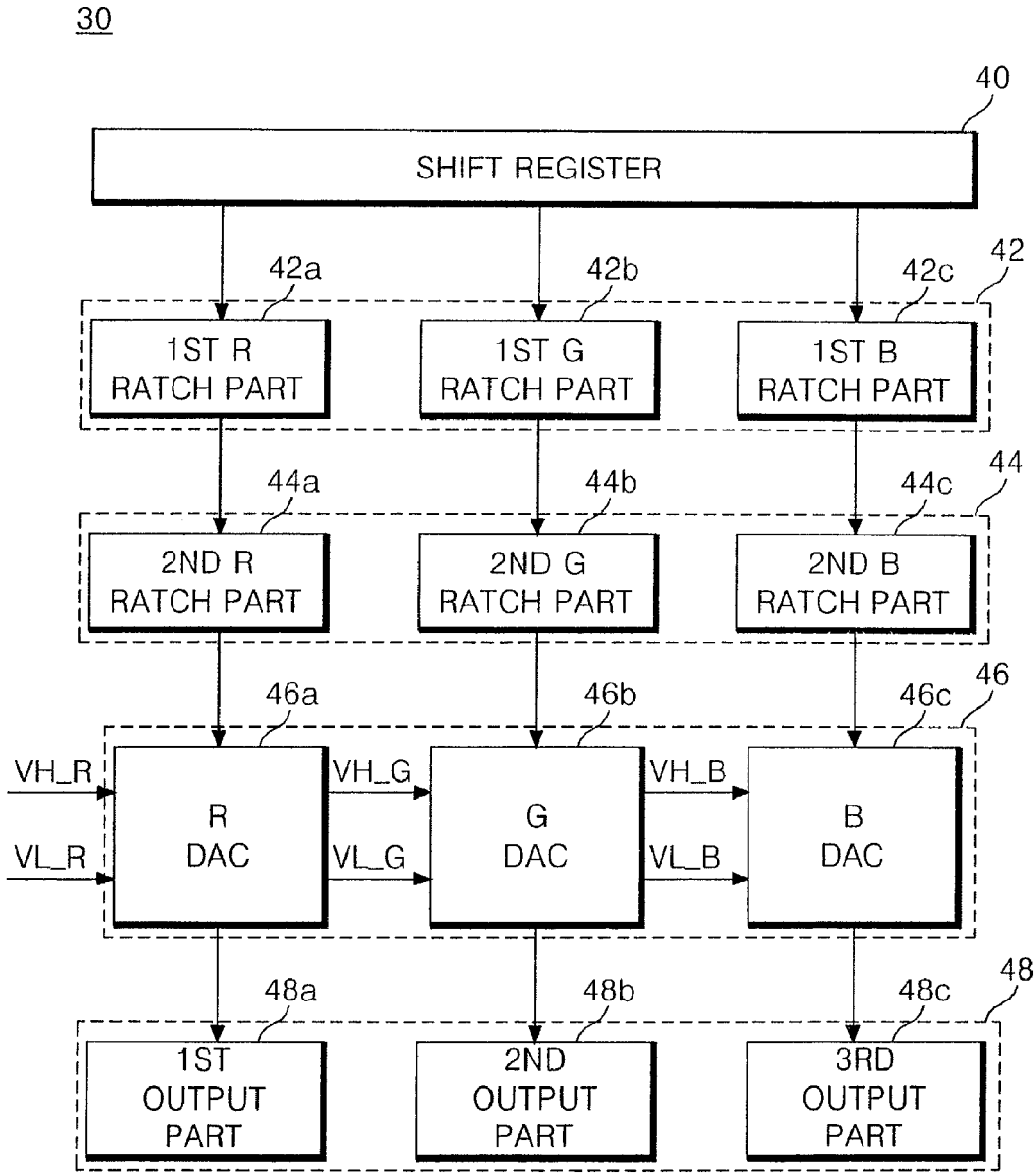
FIG. 4 RELATED ART
FIG. 4 is a diagram representing in detail a data integrated circuit shown in FIGS. 2A and 2B.
Figure 5:
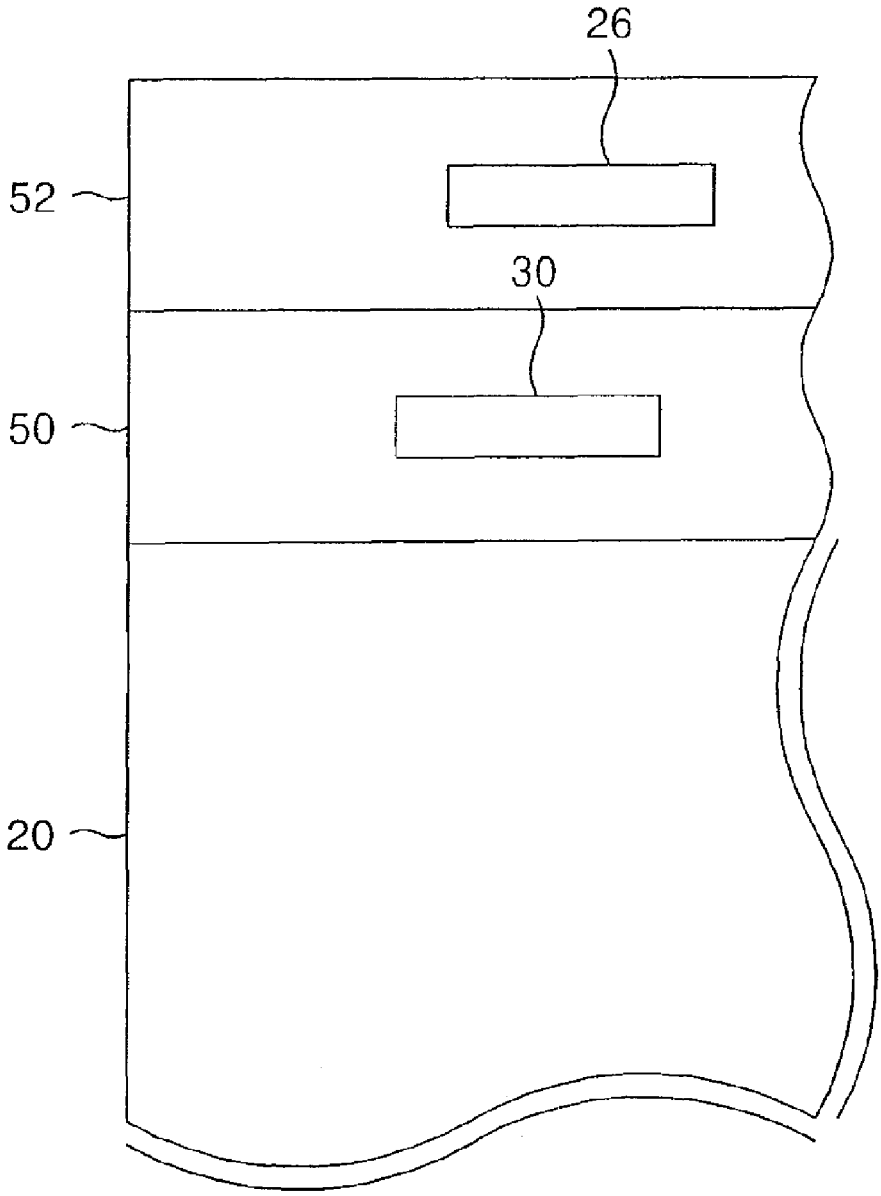
FIG. 5 RELATED ART
FIG. 5 is a diagram illustrating how to install the gamma voltage supplier and the data integrated circuit shown in FIGS. 2A and 2B.

The data integrated circuits 66, which is composed as in FIG. 4, divides a reference gamma voltage supplied from the gamma generator 100 into a plurality of voltage levels to generate a data signal, and the generated data signal is supplied to the data electrode lines DL. In other words, the data integrated circuits 66 selects the voltage level corresponding to the bit number of data to generate the data signal, and supplies the generated data signal so that the data signal to be synchronized with the scan pulse.

The gamma generator 100 supplies the reference gamma voltage to the data integrated circuits 66. For this, the gamma generator 100 includes an R reference gamma generator 68R, a G reference gamma generator 68G, and a B reference gamma generator 68B.

The R reference gamma generator 68R generates an R reference gamma voltage VH_R of low gray level and an R reference gamma voltage VL_R of high gray level, and supplies them to the data integrated circuits 66. The G reference gamma generator 68G generates an G reference gamma voltage VH_G of low gray level and an G reference gamma voltage VL_G of high gray level, and supplies them to the data integrated circuits 66. The B reference gamma generator 68B generates an B reference gamma voltage VH_B of low gray level and an B reference gamma voltage VL_B of high gray level, and supplies them to the data integrated circuits 66.

Figure 7A:
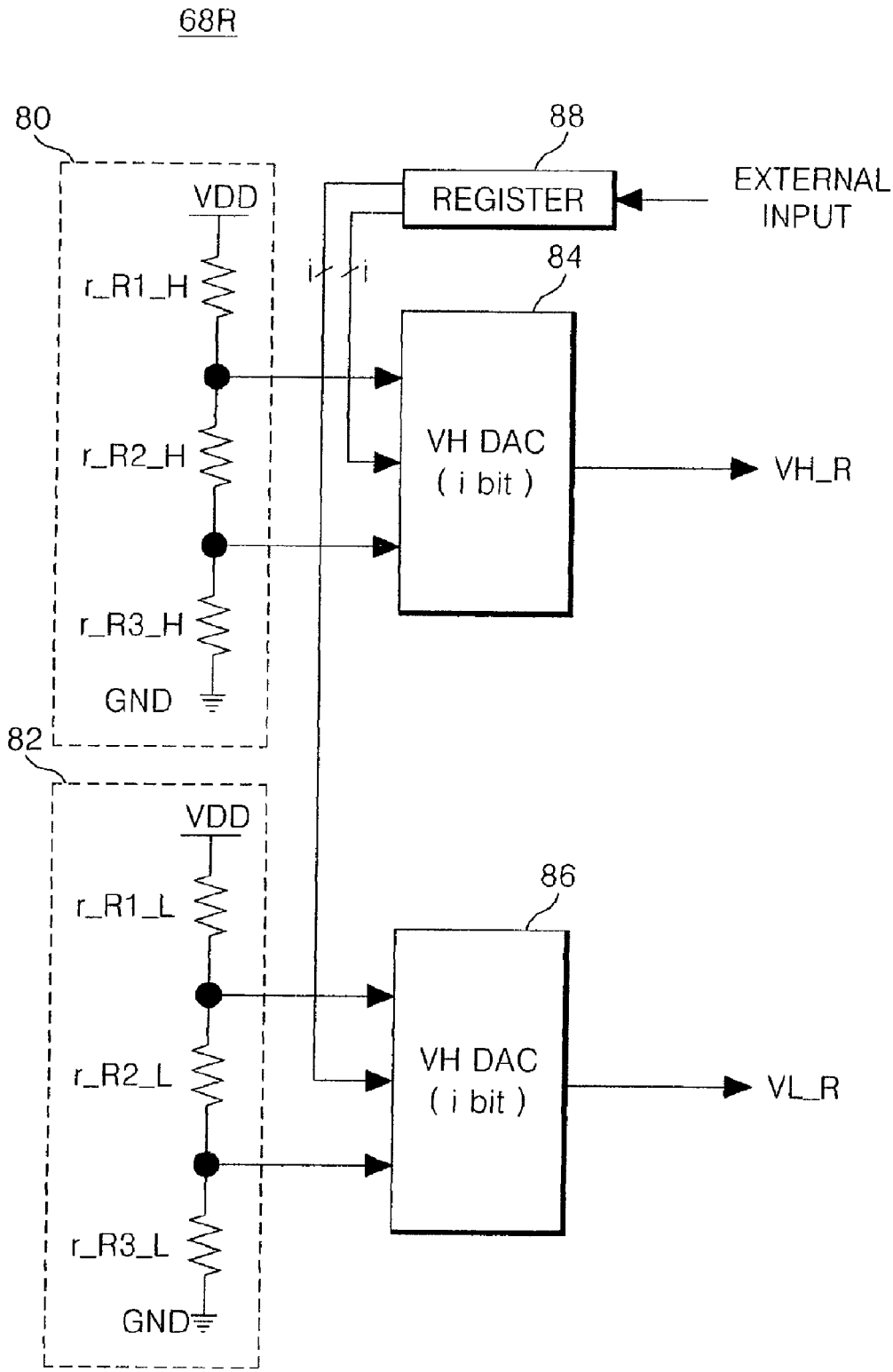
FIGS. 7A to 7C are diagrams illustrating the structure of a gamma generator shown in FIG. 6.

For this, the R reference gamma generator 68R includes resistance parts 80, 82, DAC's 84, 86, and registers 88, as in FIG. 7A.

The resistance parts 80, 82 include the first resistance part 80 and the second resistance part 82. The first resistance part 80 includes divided voltages r_R1_H, r_R2_H, r_R3_H installed between a supply voltage source and a ground voltage source GND. First and second voltages divided by the divided voltage resistors r_R1_H, r_R2_H, r_R3_H are supplied to the DAC 84. The second resistance part 82 includes divided voltages r_R1_L, r_R2_L, r_R3_L installed between a supply voltage source and a ground voltage source GND. Third and fourth voltages divided by the divided voltage resistors r_R1_L, r_R2_L, r_R3_L are supplied to the DAC 86.

The DAC's 84, 86 include a first DAC 84 and a second DAC 86. The first DAC 84 divides the first voltage and the second voltage into a plurality of voltage levels. For example, the first and second voltages are divided into $2^i$ number of voltage level, if an i (i is a natural number) bit is inputted from a register 88. And, the first DAC 84 supplies any one voltage of a plurality of voltage levels, which are divided from in correspondence to the bit number of the control data supplied from the register 88, to the data integrated circuits 66 as the R reference gamma voltage VH_R of low gray level.

The second DAC 86 divides the third voltage and the fourth voltage into a plurality of voltage levels. For example, i bit is inputted from the register 88, the third and fourth voltage is divided into $2^i$ numbers of voltage levels. And, the second DAC 86 supplies any one voltage of the voltage levels divided in correspondence to the bit number of the control data supplied from the register 88, to the data integrated circuits 66 as the R reference gamma voltage VL_R of high gray level.

In the register 88, the control data of i bit is stored to control the output voltage value of each of the first DAC 84 and the second DAC 86. In other words, the first control data of the register 88 is supplied to the first DAC 84 to control the first DAC 84. And, the second control data of the register 88 is supplied to the second DAC 86 to control the second DAC 86. Herein, the bit value of the first and second control data inputted to the register 88 is determined by a user. For example, in the register 88, it is possible to store the control data value that can compensate the brightness deviation generated between the EL display panels 60.

To described this in detail, when a brightness deviation exists between the EL display panels 60, a user controls the first and second data value, which are to be stored in the register 88, to compensate the brightness deviation between the EL display panels 60.

A mode controller (not shown) is installed in an input terminal of the register 88, and the register 88 receives the first and second control data from the mode controller to control the output values of the first and second DAC's 84, 86, thus it is possible to control to display a picture of an appropriate brightness that corresponds to an external environment, i.e., day, night, rain, snow and etc.

Figure 7B:
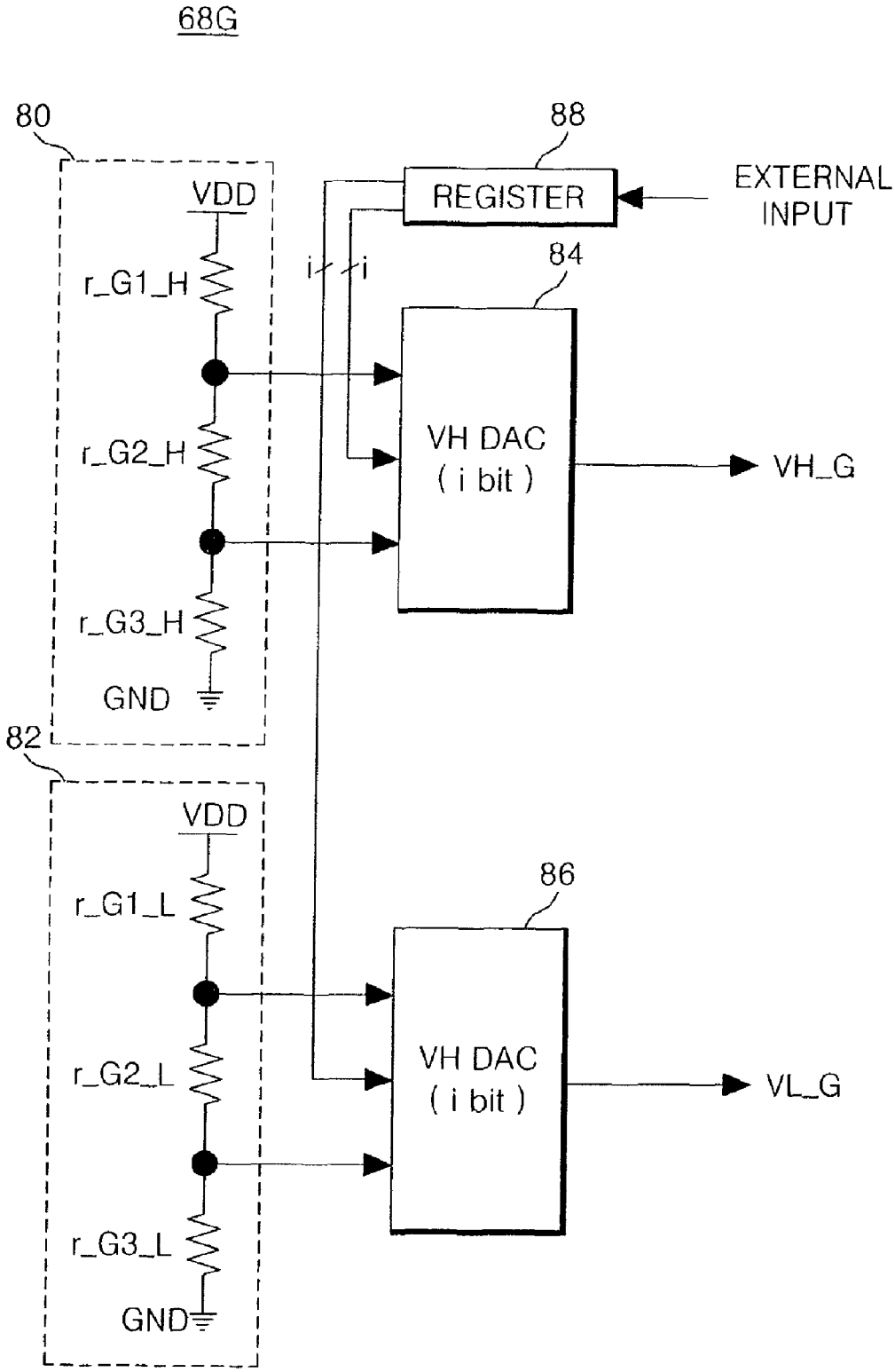
Figure 7C:
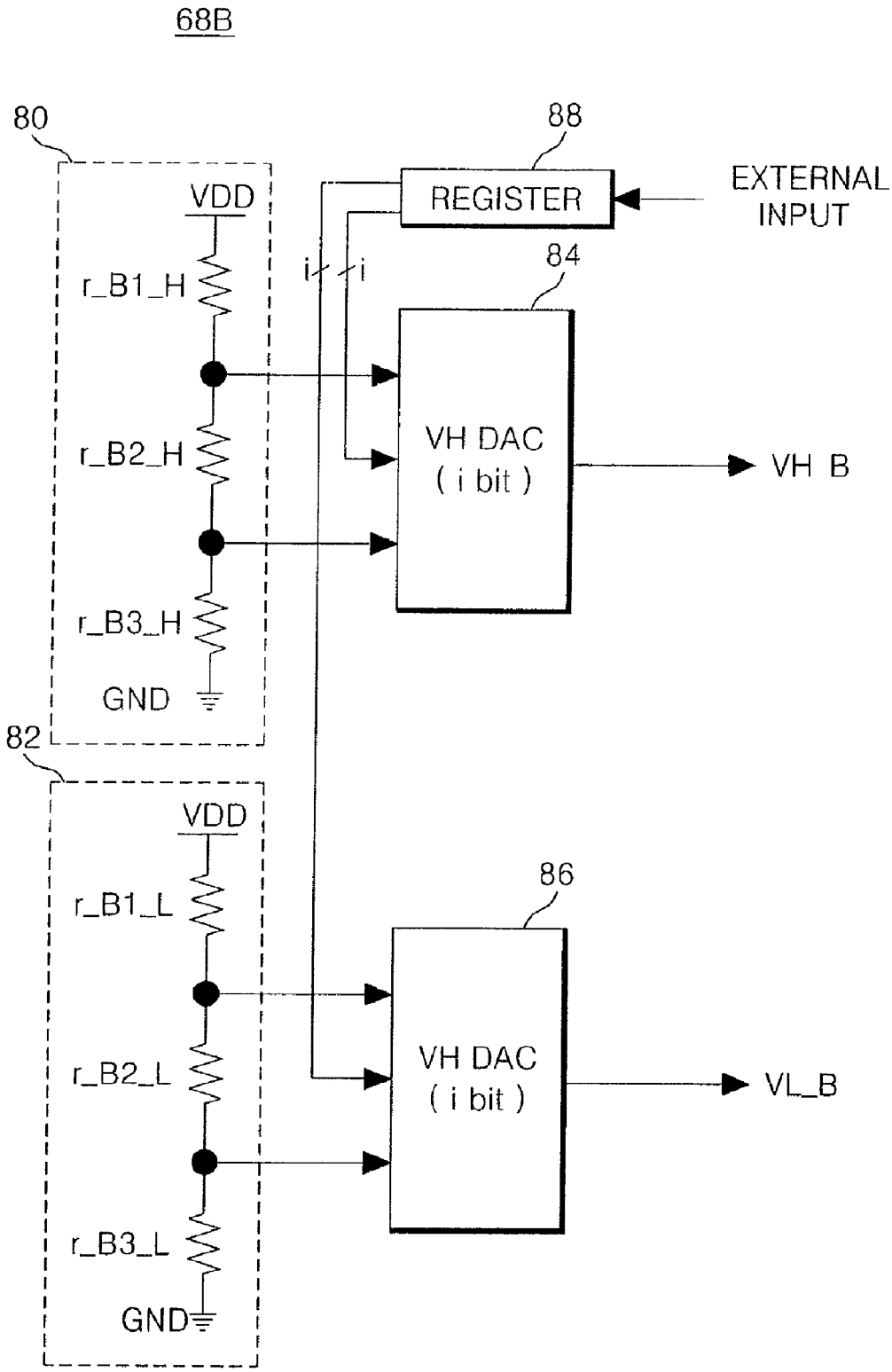

On the other hand, the G gamma generator 68G and the B gamma generator 68B are composed as in FIGS. 7B and 7C in this invention. The value stored at the register 88 included in the G gamma generator 68G and the B gamma generator 68B are set to have the white balance of the R cell, G cell and B cell balanced. The operation process is substantially the same as the foregoing R gamma generator 68R, thus a detailed description is to be omitted.

Figure 1:
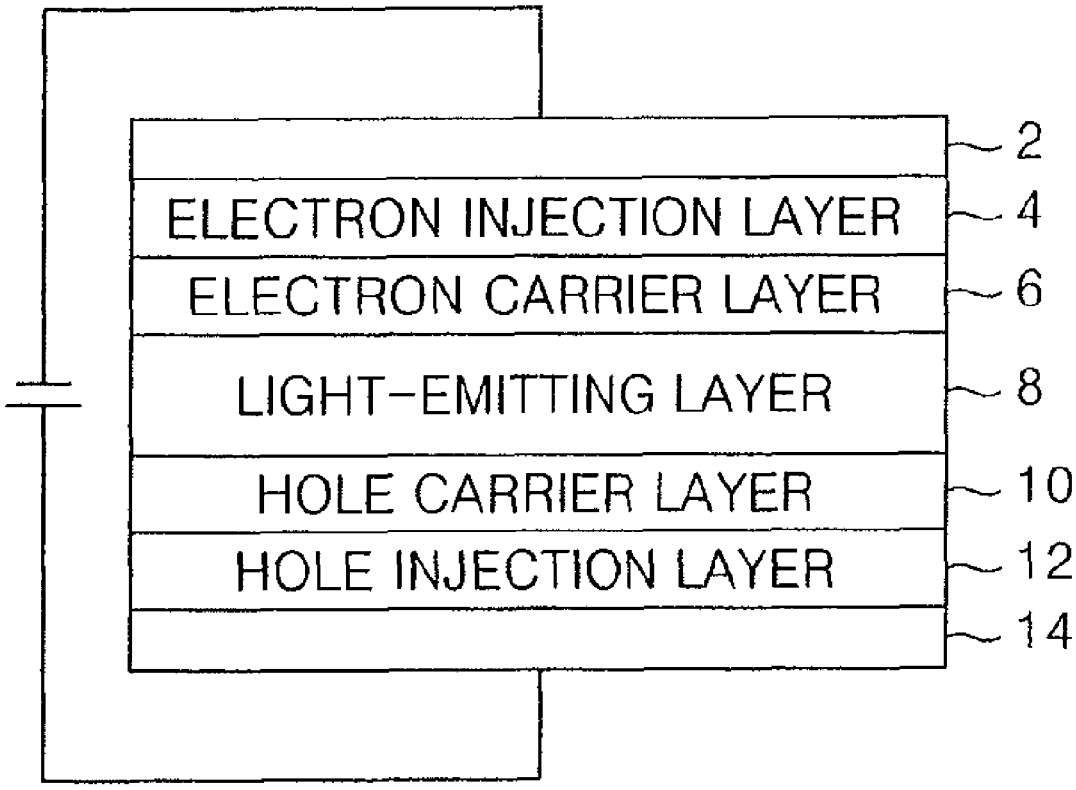
FIG. 1 RELATED ART
FIG. 1 is a sectional diagram illustrating the structure of a general organic electro-luminescence.
Figure 2A:
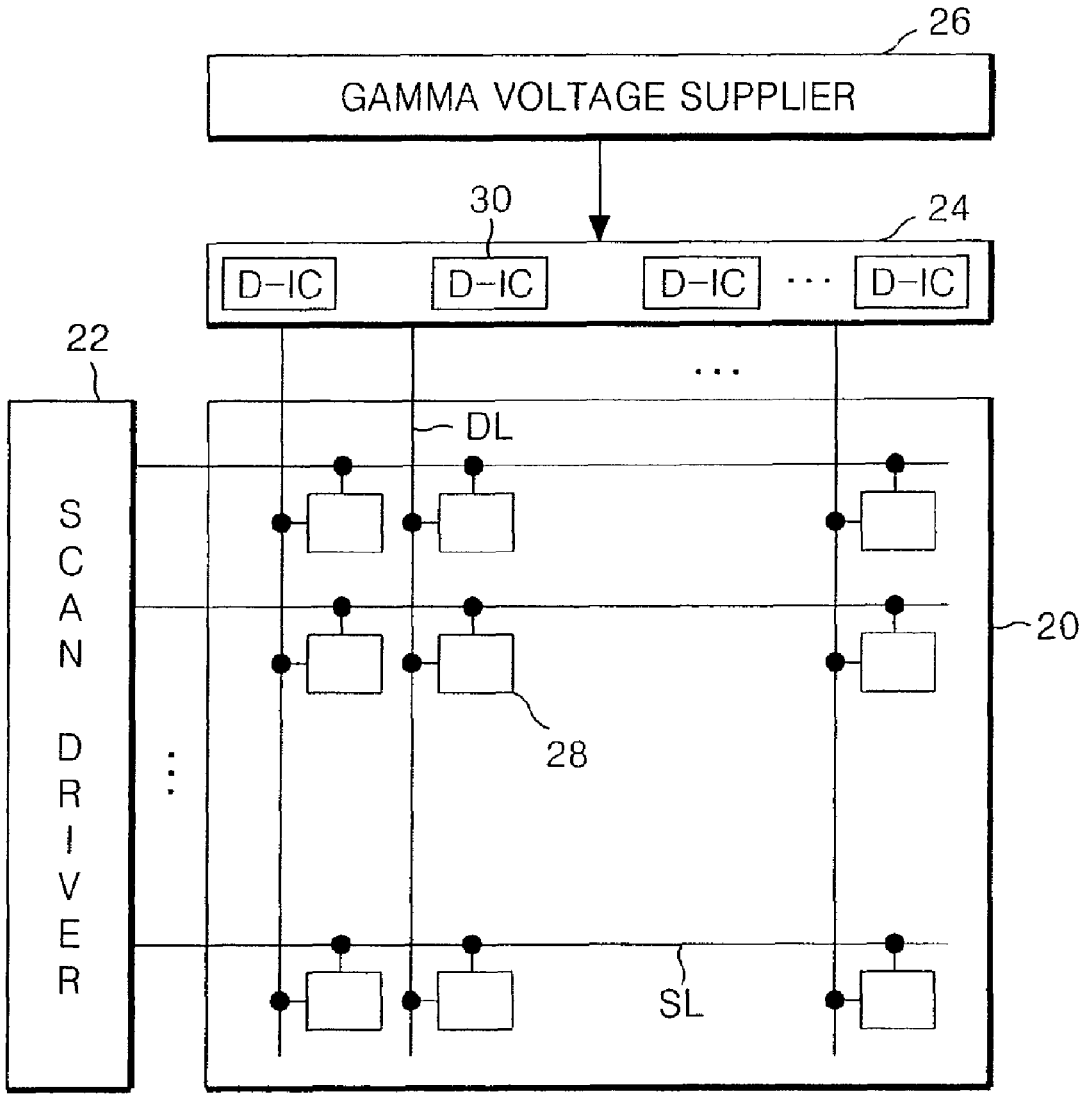
FIG.2A RELATED ART
FIGS. 2A and 2B are diagrams representing an electro-luminescence display device of the prior art.
Figure 2B:
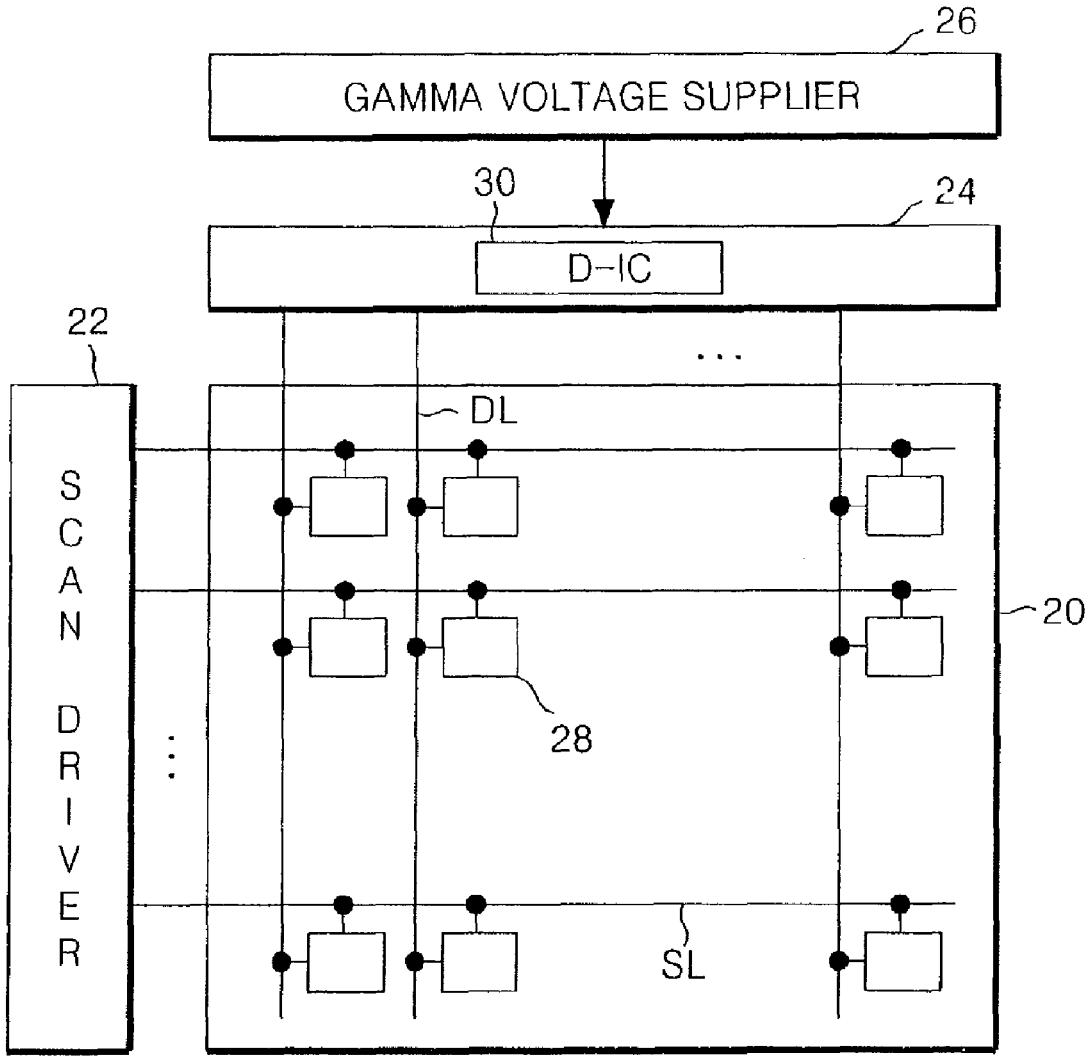
FIG.2B RELATED ART
Figure 3:
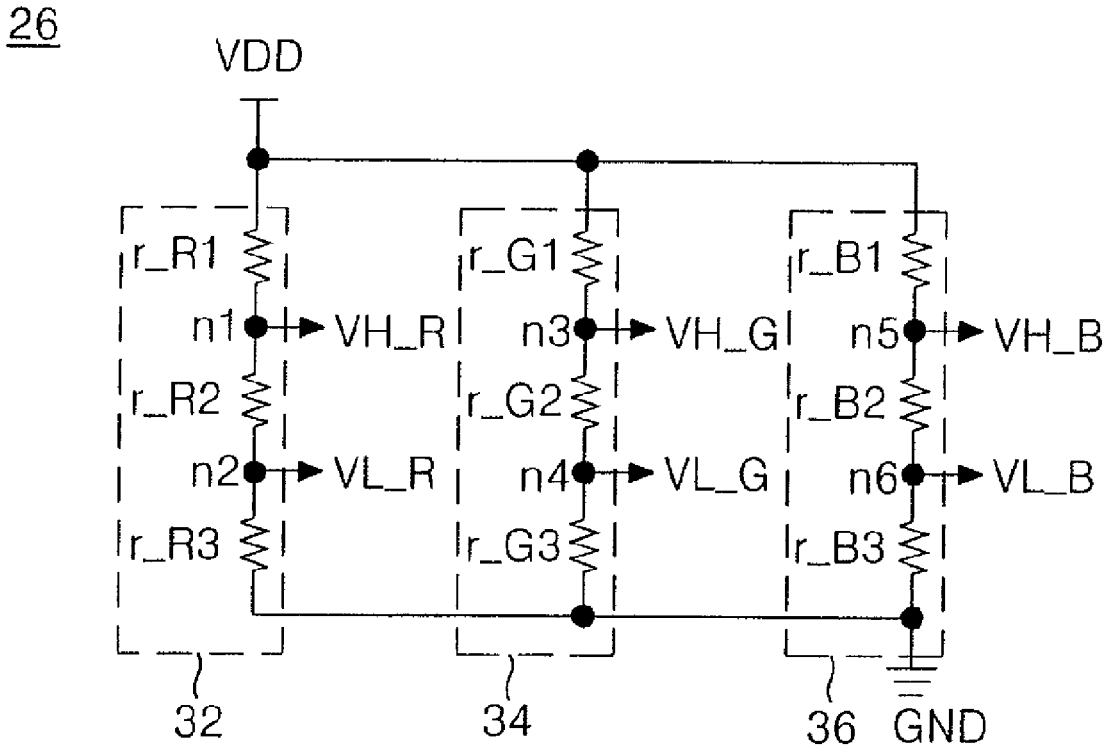
FIG.3 RELATED ART
FIG. 3 is a circuit diagram representing the structure of a gamma voltage supplier shown in FIGS. 2A and 2B.
Figure 8:
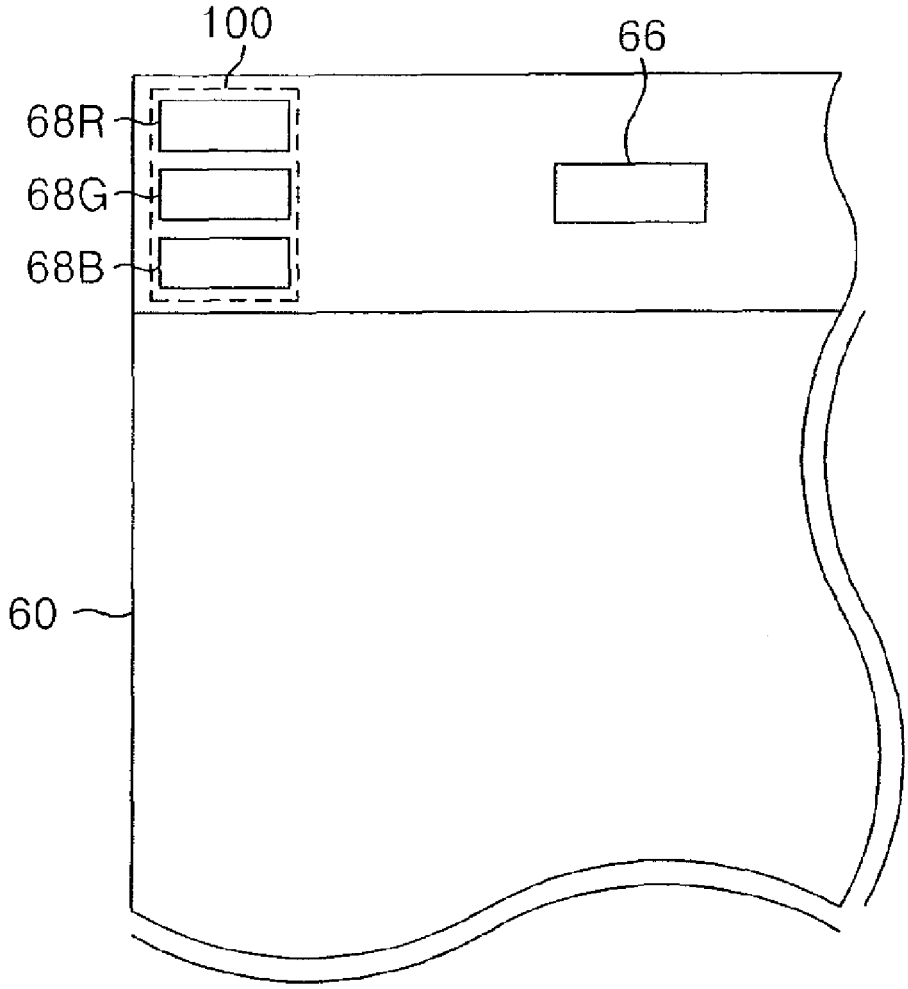
FIG. 8 is a diagram illustrating how to install the gamma generator and a data integrated circuit shown in FIG. 6.

The gamma generator 100 includes a fewer number of resistors than the gamma voltage supplier 26 of the prior art shown in FIG. 3. Accordingly, the gamma generator 100 of the present invention can be mounted on a COF 102 along with the data integrated circuit 66 as shown in FIG. 8. In this way, if the gamma generator 100 on the COF 102, its manufacturing cost can be reduced.

Figure 9:
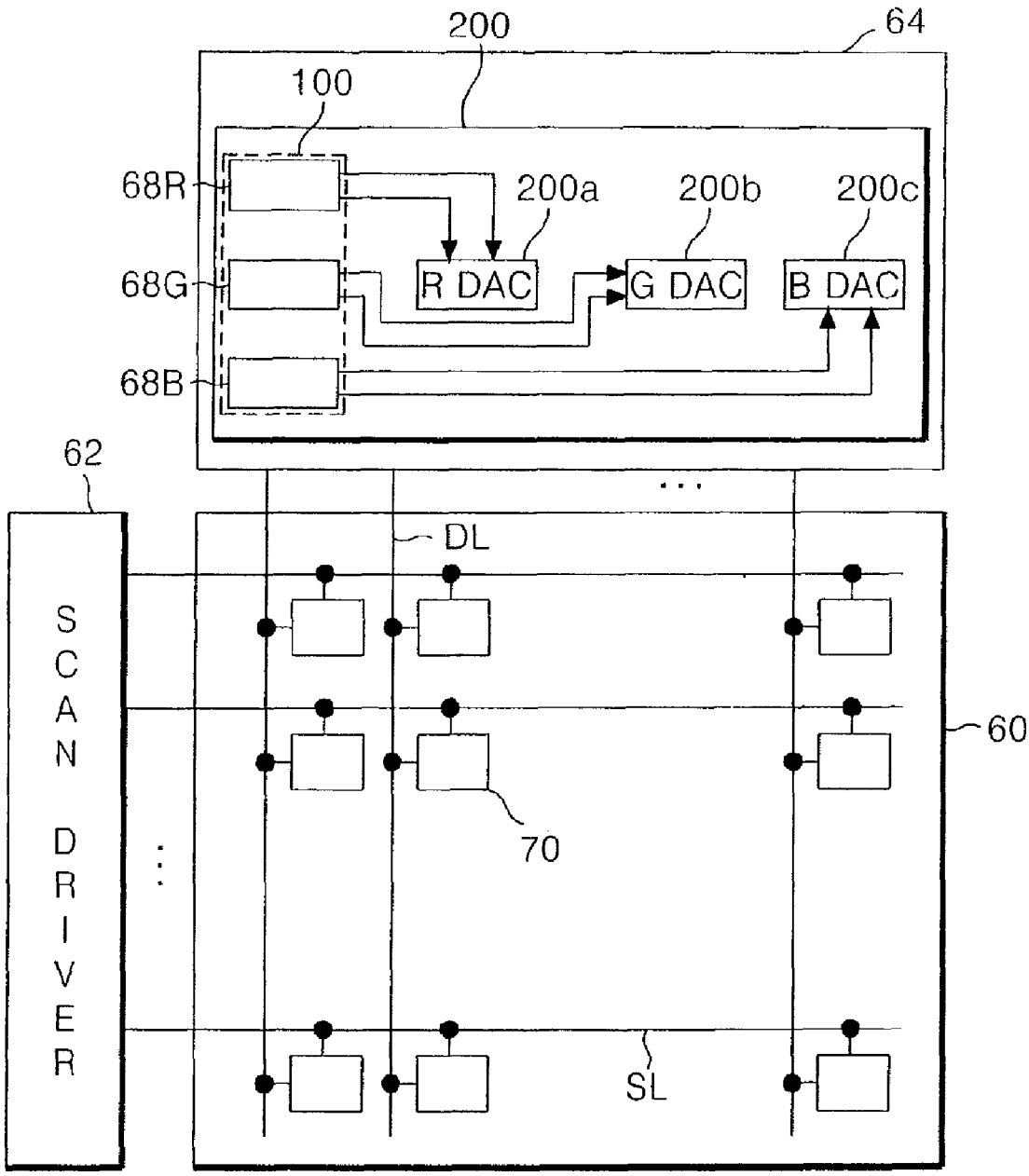
FIG. 9 is a diagram representing an electro-luminescence display device according to a second embodiment of the present invention.

FIG. 9 is a diagram illustrating an EL display device according to a second embodiment of the present invention. In the embodiment, it is assumed that one data integrated circuit 200 is mounted on the data driver 64. In FIG. 9, the same composition as FIG. 6 is to be given the same reference numerals and of which the further description is to be omitted.

Referring to FIG. 9, the EL display device according to the second embodiment of the present invention includes an EL display panel 60 having EL cells 70 arranged at each intersection of scan electrode lines SL and data electrode lines DL, a scan driver 62 to drive the scan electrode lines SL, and a data driver 64 to drive the data electrode lines DL.

Each of the EL cells 70 is selected when a scan pulse is applied to the scan electrode line SL, to generate the light corresponding to a data signal supplied to the data electrode line DL. In other words, because a designated light corresponding to the data signal is generated in each of the EL cells 70, a designated picture is displayed in the EL display panel 60.

The scan driver 62 sequentially supplies the scan pulse to a plurality of scan electrode lines SL.

The data driver 64 includes one data integrated circuit 200. A reference gamma generator 100 is built in the data integrated circuit 200. And, the other configuration is made as in FIG. 4.

The reference gamma generator 100 includes an R reference gamma generator 68R, a G reference gamma generator 68G and a B reference gamma generator 68B. The R reference gamma generator 68R generates an R reference gamma voltage VH_R of low gray level and an R reference gamma voltage VL_R of high gray level to supply it to an R DAC 200A. And, the G reference gamma generator 68G generates a G reference gamma voltage VH_G of low gray level and a G reference gamma voltage VL_G of high gray level to supply it to a G DAC 200B. And, the B reference gamma generator 68B generates a B reference gamma voltage VH_B of low gray level and a B reference gamma voltage VL_B of high gray level to supply it to a B DAC 200C.

Herein, the composition of each of the R reference gamma generator 68R, the G reference gamma generator 68G and the B reference gamma generator 68B is the same as in FIGS. 7A to 7C, thus their further detail description will be omitted.

A gamma generator 100 is integrated in the inside of the data integrated circuit 200 in the second embodiment, differently from the first embodiment. If the gamma generator 100 is integrated in the inside of the data integrated circuit 200 in this way, their mounting time is shortened when compared with the case that the data integrated circuit and the gamma generator are separated.

Figure 10:
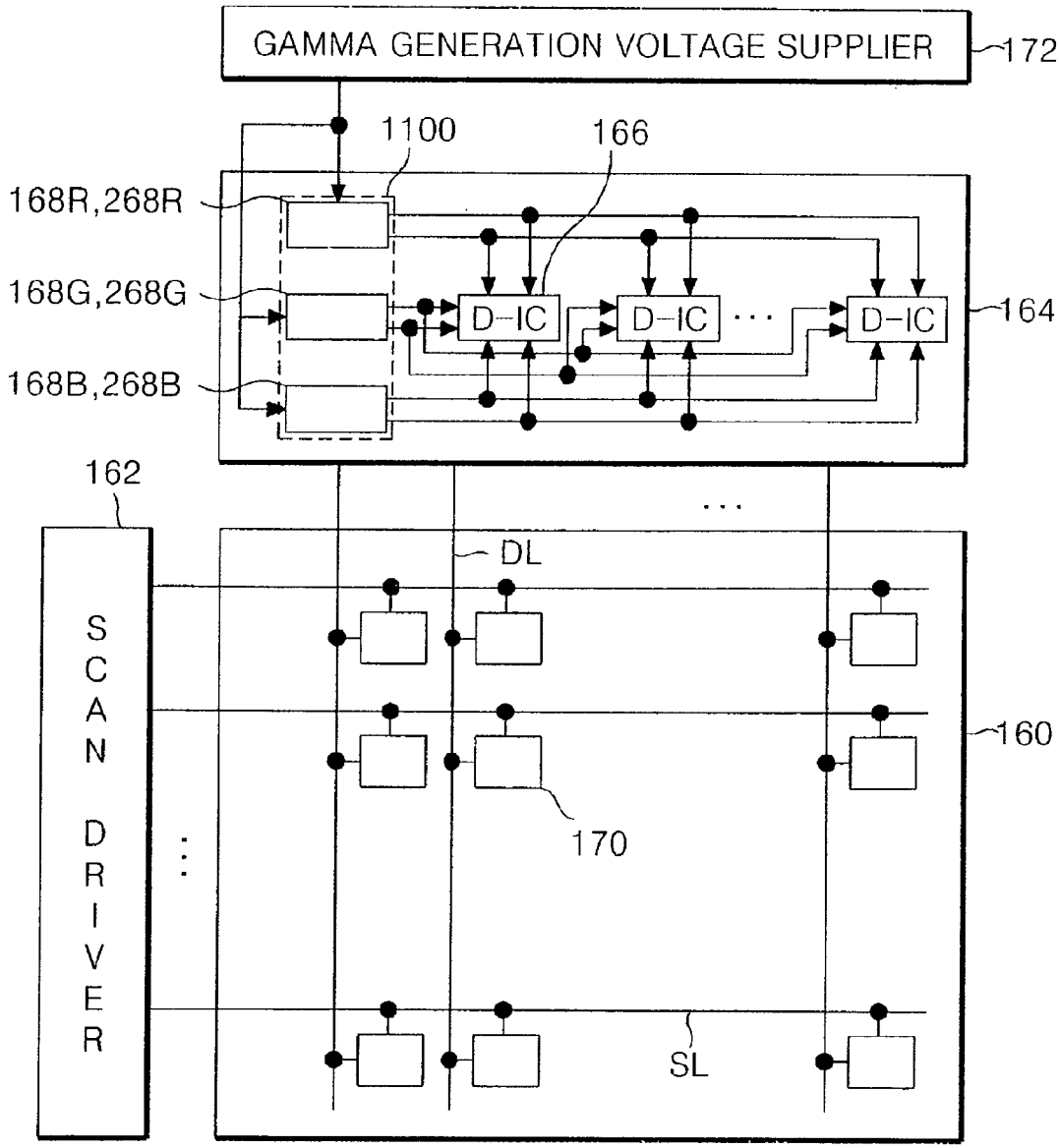
FIG. 10 is a diagram representing an electro-luminescence display device according to a third embodiment of the present invention.
Figure 11:
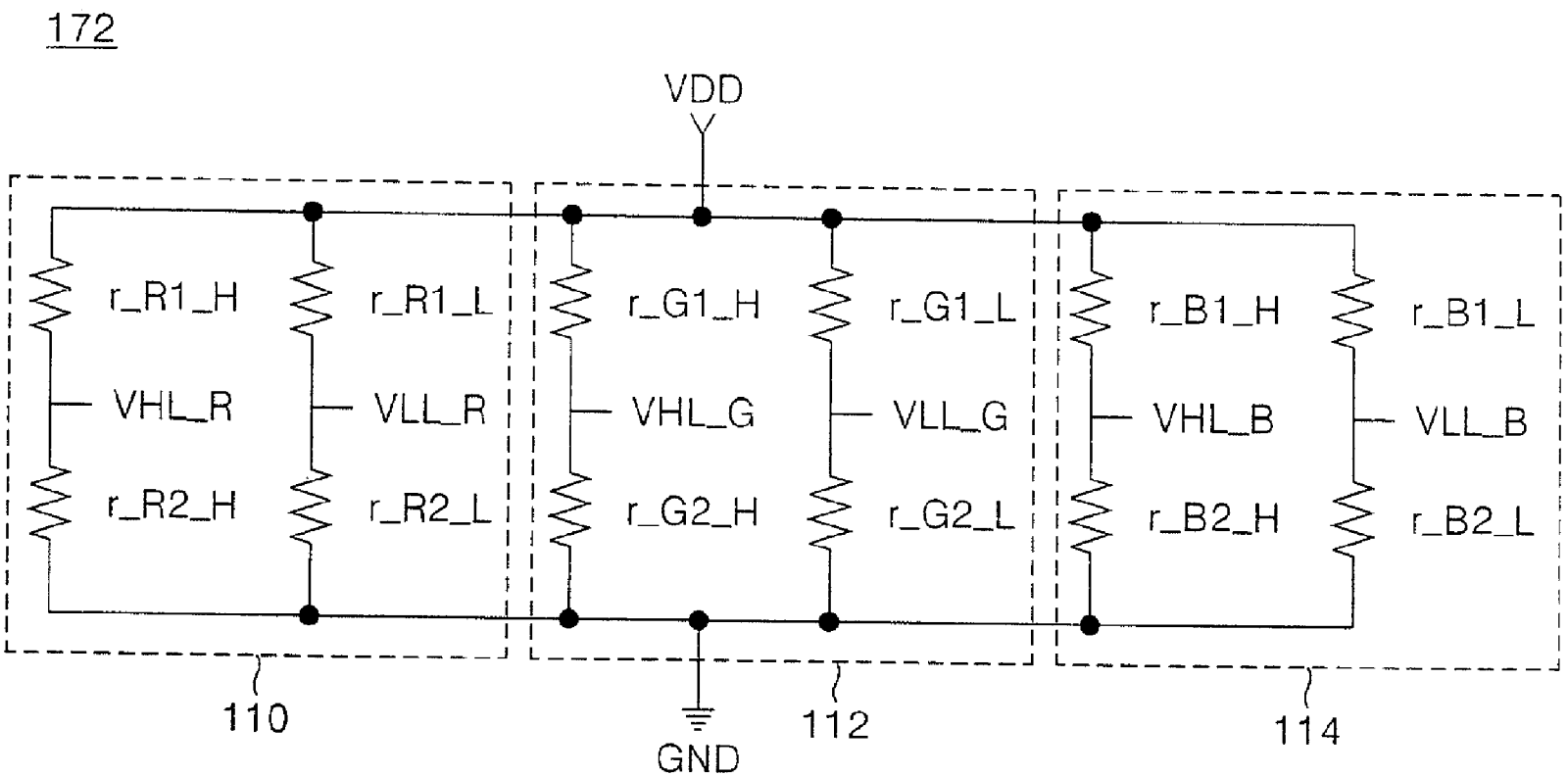
FIG. 11 is a circuit diagram illustrating in detail a gamma generation voltage supplier shown in FIG. 10.

FIG. 10 is a diagram illustrating an EL display device according to a third embodiment of the present invention.

Referring to FIG. 10, an EL display device according to the embodiment of the present invention includes an EL display panel 160 having EL cells 170 arranged at each intersection of scan electrode lines SL and data electrode lines DL, a scan driver 162 to drive the scan electrode lines SL, a data driver 164 to drive the data electrode lines DL, and a gamma generation voltage supplier 172 to supply a gamma generation voltage to the data driver 164 so that a reference gamma voltage is generated.

Each of the EL cells 170 is selected when a scan pulse is applied to the scan electrode line SL, to generate the light corresponding to a data signal supplied to the data electrode line DL. In other words, when a designated light corresponding to the data signal is generated in each of the EL cells 170, a designated picture is displayed in the EL display panel 160.

The scan driver 162 sequentially supplies the scan pulse to a plurality of scan electrode lines SL.

The gamma generation voltage supplier 172 supplies a plurality of gamma generation voltages to the data driver 164 so that the reference gamma voltage is generated in the data driver 164. Herein, the gamma generation voltage supplier 172 includes an R gamma generation voltage part 110, a G gamma generation voltage part 112 and a B gamma generation voltage part 114 as in FIG. 11 so that the reference gamma voltage is generated differently by R cell, G cell and B cell. Each of the gamma generation voltage part 110, 112, 114 is composed of divided voltage resistors to divide the voltage of a supply voltage source VDD.

The R gamma generation voltage part 110 includes two first divided voltage resistors r_R1_H, r_R2_H installed in series between the supply voltage source VDD and a ground voltage source GND to generate an R gamma generation voltage VHL_R of low gray level, and two second divided voltage resistors r_R1_L, r_R2_L installed in series between the supply voltage source VDD and the ground voltage source GND to generate an R gamma generation voltage VLL_R of high gray level.

Likewise, the G gamma generation voltage part 112 is composed of first divided voltage resistors r_G1_H, r_G2_H and second divided voltage resistors r_G1_L, r_G2_L to generate a G gamma generation voltage VHL_G of low gray level and a G gamma generation voltage VLL_G of high gray level. And, the B gamma generation voltage part 114 is composed of first divided voltage resistors r_B1_H, r_B2_H and second divided voltage resistors r_B1_L, r_B2_L to generate a B gamma generation voltage VHL_B of low gray level and a B gamma generation voltage VLL_B of high gray level.

The data driver 164 includes a reference gamma generator 1100 and a plurality of data integrated circuits 166. The data integrated circuits 166 is composed as in FIG. 4, generates a data signal by dividing the reference gamma voltage supplied from the reference gamma generator 1100 into a plurality voltage levels, and supplies the generated data signal to the data electrode lines DL.

The reference gamma generator 1100 generates the reference gamma voltage in use of the gamma generation voltage supplied from the gamma generation voltage supplier 172. For this, the reference gamma generator 1100 includes R reference gamma generators 168R, 268R, G reference gamma generators 168G, 268G, B reference gamma generators 168B, 268B.

A first embodiment of the reference gamma generator 1100 shown in FIG. 10 is as follows.

The R reference gamma generator 168R generates the R reference gamma voltage VH_R of low gray level and the R reference gamma voltage VL_R of high gray level in use of the R gamma generation voltage VHL_R of low gray level and the R gamma generation voltage VLL_R of high gray level.

The G reference gamma generator 168G generates the G reference gamma voltage VH_G of low gray level and the G reference gamma voltage VL_G of high gray level in use of the G gamma generation voltage VHL_G of low gray level and the G gamma generation voltage VLL_G of high gray level.

The B reference gamma generator 168B generates the B reference gamma voltage VH_B of low gray level and the B reference gamma voltage VL_B of high gray level in use of the B gamma generation voltage VHL_B of low gray level and the B gamma generation voltage VLL_B of high gray level.

The R reference gamma generation 168R, the G reference gamma generation 168G and the B reference gamma generation 168B have different resistance value and control data value within the register, and have the same circuit composition. Putting focus on the R reference gamma generator 168R, the operation of the reference gamma generators 168R, 168G and 168B is described.

Figure 12:
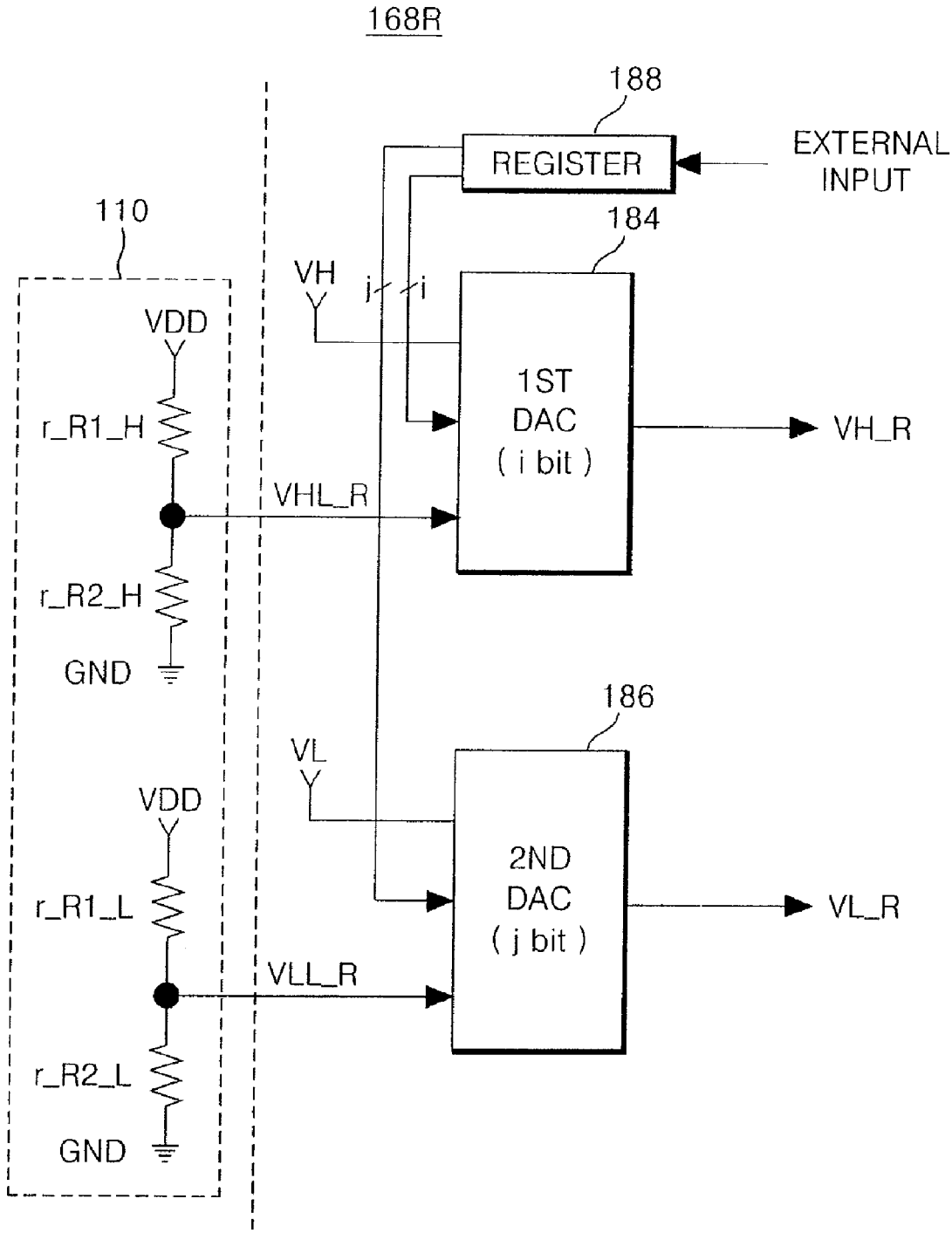
FIG. 12 is a diagram illustrating in detail a reference gamma generator shown in FIG. 10.
Figure 13:
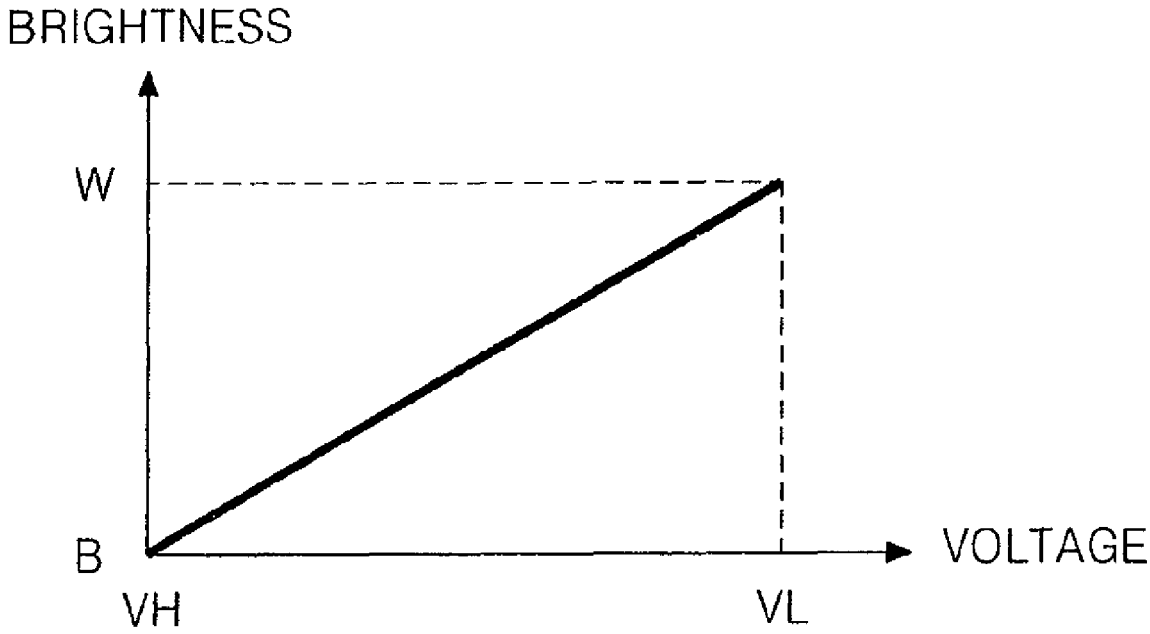
FIG. 13 is a graph illustrating in brief a brightness change corresponding to a voltage value.

The R reference gamma generator 168R includes a first DAC 184, a second DAC 186 and a register 188 as in FIG. 12.

The first DAC 184 receives a first reference voltage VH from the external, and receives the R gamma generation voltage VHL_R of low gray voltage from the R gamma generation voltage part 110. Herein, the first reference voltage is higher than the R gamma generation voltage VHL_R of low gray level. The first DAC 184 is composed of i (i is a natural number) bits, and divides the first reference voltage VH and the R gamma voltage into $2^i$ numbers of voltage levels. And, the first DAC 184 supplies any one voltage among the voltages to the data integrated circuits 66, as the R reference gamma voltage VH_R of low gray level, in correspondence to the bit of the first control data supplied from the register 188.

The second DAC 186 receives a second reference voltage VL from the external, and receives the R gamma generation voltage VLL_R of high gray voltage from the R gamma generation voltage part 100. Herein, the second reference voltage is a voltage between the first reference voltage VH and the R gamma generation voltage VLL_R of high gray level. The second DAC 186 is composed of j (j is a natural number) bits, and divides the second reference voltage VL and the R gamma voltage into $2^i$ numbers of voltage levels. And, the second DAC 186 supplies any one voltage among the voltages to the data integrated circuits 166, as the R reference gamma voltage VL_R of high gray level, in correspondence to the bit of the second control data supplied from the register 188.

On the other hand, the second DAC 186 is composed to have more voltage levels than the first DAC 184 in this invention. In other words, the second DAC 186 outputs any one of the reference gamma voltage of $2^i$ numbers of voltage levels when compared with that the first DAC 184 outputs any one among the reference gamma voltages of the $2^i$ numbers of voltage levels, which is smaller than this. In this way, because the second DAC 186 selects the reference gamma voltage among the reference gamma voltages of the larger voltage levels, the present invention might control the R reference gamma voltage VL_R of high gray level more precisely than the prior art, thus the brightness deviation between the display panels 160 might be minimized. To describe this more precisely, the brightness of the display panel 160 might be expressed as in FIG. 13. In other words, black is displayed when the R reference gamma voltage VH_R of low gray level is supplied, and white is displayed when the R reference gamma voltage VL_R of high gray level is supplied. Herein, the brightness difference between low gray levels might not be easily distinctive with bare eyes, thus the gamma reference voltage is controlled by designated values so that it is relatively easy to similarly control the black brightness between the display panels 160. On the contrary, the brightness difference between high gray levels is easily distinctive with bare eyes, thus the gamma reference voltage is divided into many voltage levels and one of them is selected, so that the white brightness between the display panels 160 might be set similarly.

According to an experiment result, in order to similarly set the brightness of low gray level between the display panels 160, the gamma voltage is to be controlled at the range of approximate 3V. For example, when the first reference voltage VH: 14V, the R gamma generation voltage VHL_R: 11V are each set and when the voltage between the first reference voltage VH and the R gamma generation voltage VHL_R is subdivided to be about 0.2V, the brightness difference of the low gray level can be similarly set between the display panels 160. Herein, when the first DAC 184 is set to be 4 bits, the 3V voltage is subdivided to have a voltage difference of about 0.1875V, thus the brightness of the low gray level might be similarly or identically set between the display panels 160.

Further, the voltage value is to be controlled at the rage of about 5V in order that the brightness of the gray level is similarly set between the display panels 160. For example, when the second reference voltage VL: 6V, the R gamma generation voltage VLL_R: 1V are each set and when the voltage between the second reference voltage VL and the R gamma generation voltage VLL_R is subdivided to be about 0.1 V, the brightness difference of the high gray level can be similarly set between the display panels 160. Herein, when the second DAC 186 is set to be 6 bits, the 5V voltage is subdivided to have a voltage difference of about 0.078125V, thus the brightness of the high gray level might be similarly or identically set between the display panels 160.

The first control data of i bit is stored at the register 188 to control the output value of the first DAC 184. And the second control data of j bit is stored at the register 188 to control the output value of the second DAC 186. Herein, the bit value of the first and second control data inputted into the register 188 is determined by a user. For example, the first and second control data, which can compensate the brightness deviation generated between the EL display panels 60, is stored at the register 188. When the brightness deviation is generated between the EL display panel 160, the user controls the first and second control data values inputted to the register 188 thus the brightness deviation between the EL display panels 60 can be compensated. Further, a mode controller (not shown) is installed at the input terminal of the register 188, and the register 188 receives the first and second control data from the mode controller to control the output of the first and second DAC 184, 186, thus it is possible to control to display a picture of an appropriate brightness that corresponds to an external environment, i.e., day, night, rain, snow and etc.

The value stored at the register 188 included in the G reference gamma generator 168G and the B reference gamma generator 168B is set to make the white balance of the R cell, G cell and B cell balanced.

On the other hand, the gamma generation voltage supplier 172 of the present invention might be realized in many ways. For example, the gamma generation voltage supplier 172 might be composed as in FIG. 14. The R gamma generation voltage part 110, the G gamma generation voltage part 112 and the B gamma generation voltage part 114 have substantially the same circuit composition except that the generated voltage value is different.

Figure 14:
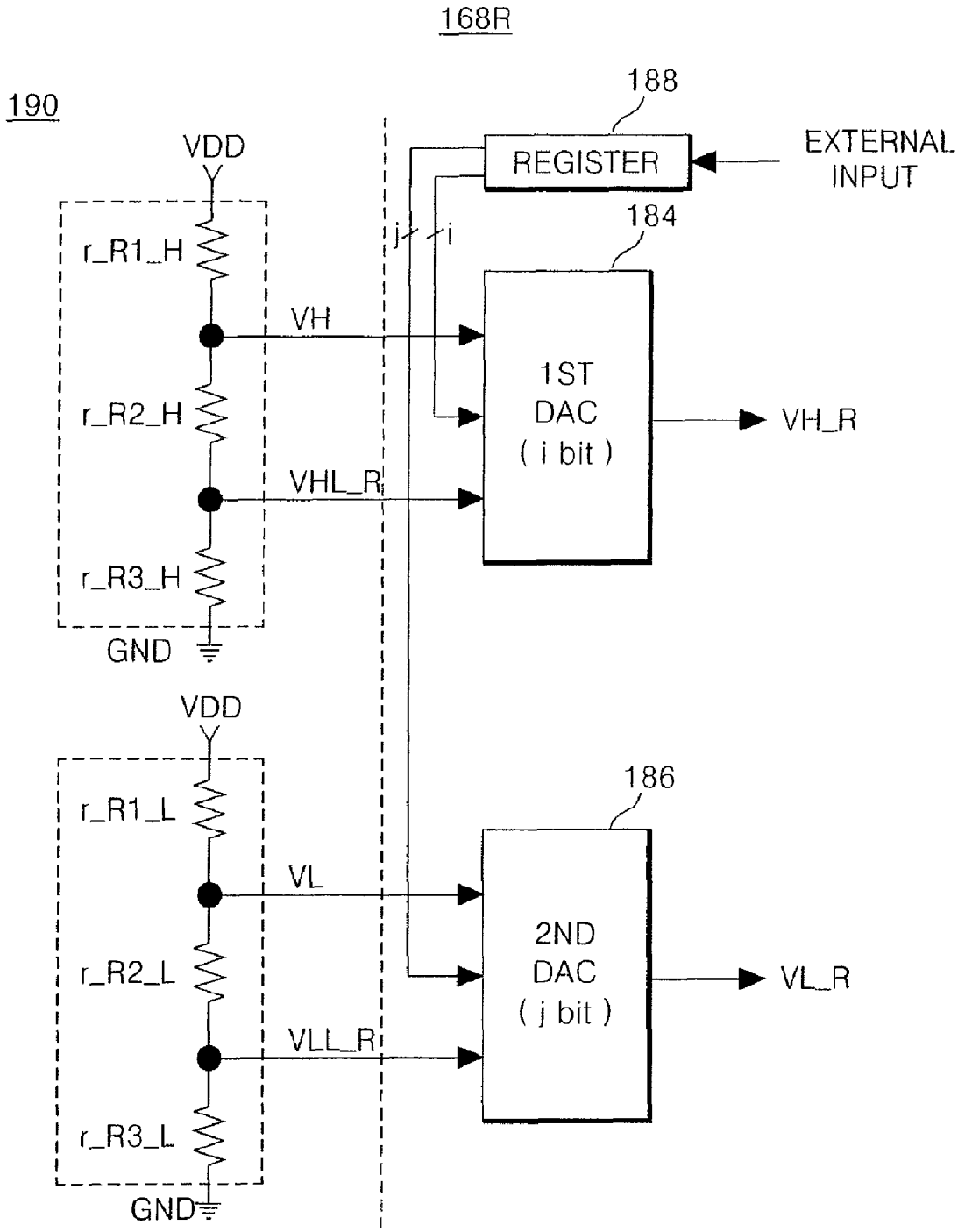
FIG. 14 is a circuit diagram illustrating another embodiment of the gamma generation voltage supplier.

Referring to FIG. 14, the R gamma generation voltage part 190 includes first divided voltage resistors r_R1_H, r_R2_H, r_R2_H, and second divided voltage resistors r_R1_L, r_R2_L, r_R2_L installed in series between the supply voltage source VDD and the ground voltage source GND. Each of the first and second divided resistors includes three resistors. When comparing the R gamma generation voltage part 190 with the R gamma generation voltage part 110 of FIG. 12, the R gamma generation voltage part 110 shown in FIG. 12 has three resistors in each of the first and second divided voltage resistors and generates the first reference voltage VH, the R gamma generation voltage VHL_R of low gray level, the second reference voltage VL and the R gamma generation voltage VLL_R of high gray level.

In other words, the R gamma generation voltage part 190 of FIG. 14 additionally generates the first reference voltage VH to supply it to the first DAC 184 as well as additionally generating the second reference voltage VL to supply it to the second DAC 186. In this way, when the first reference voltage and the second reference voltage VL are additionally generated in the R gamma generation voltage part 190, there is an advantage that the brightness of the display panel 160 might be more easily controlled.

Figure 15:
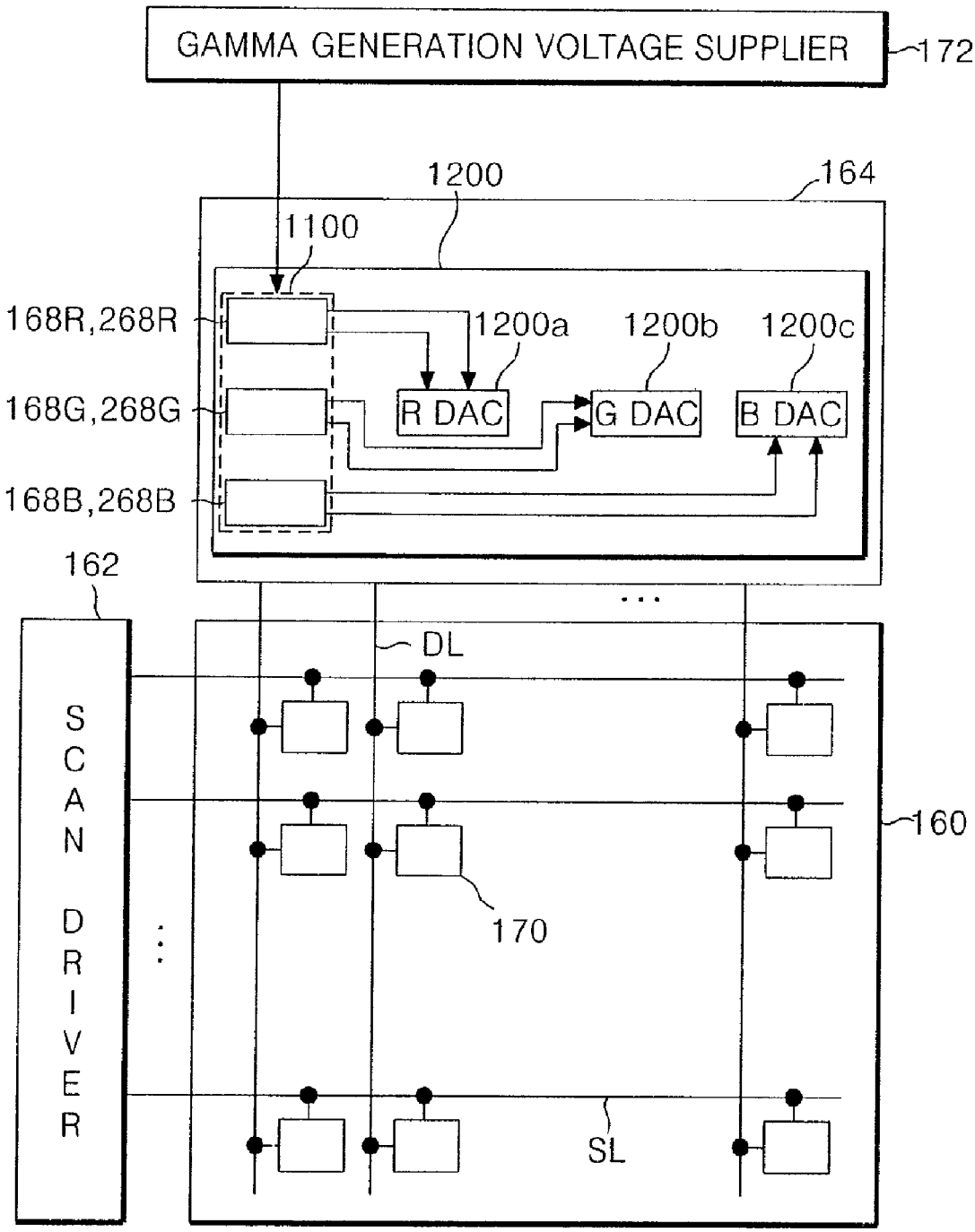
FIG. 15 is a diagram illustrating an embodiment that the reference gamma generator is integrated in the inside of the data integrated circuit.

And, in the present invention, the data driver 164 as in FIG. 15 includes one data integrated circuit 1200. The reference gamma generator 1100 is integrated in the inside of the data integrated circuit 1200. Herein, the R reference gamma generator 168R generates the R gamma voltage VH_R of low gray level and the R gamma voltage VL_R of high gray level to supply them to an R DAC 1200A. The G reference gamma generator 168G generates the G gamma voltage VH_G of low gray level and the G gamma voltage VL_G of high gray level to supply them to an G DAC 1200B. The B reference gamma generator 168B generates the B gamma voltage VH_B of low gray level and the B gamma voltage VL_B of high gray level to supply them to an B DAC 1200C.

The composition of each of the R reference gamma generator 168R, the G reference gamma generator 168G and the B reference gamma generator 168B is substantially the same as the embodiment of FIG. 12.

In this way, when the gamma generator 1100 is integrated in the inside of the data integrated circuit 1200, it is possible to obtain an additional effect that its mounting time is shortened.

Figure 16:
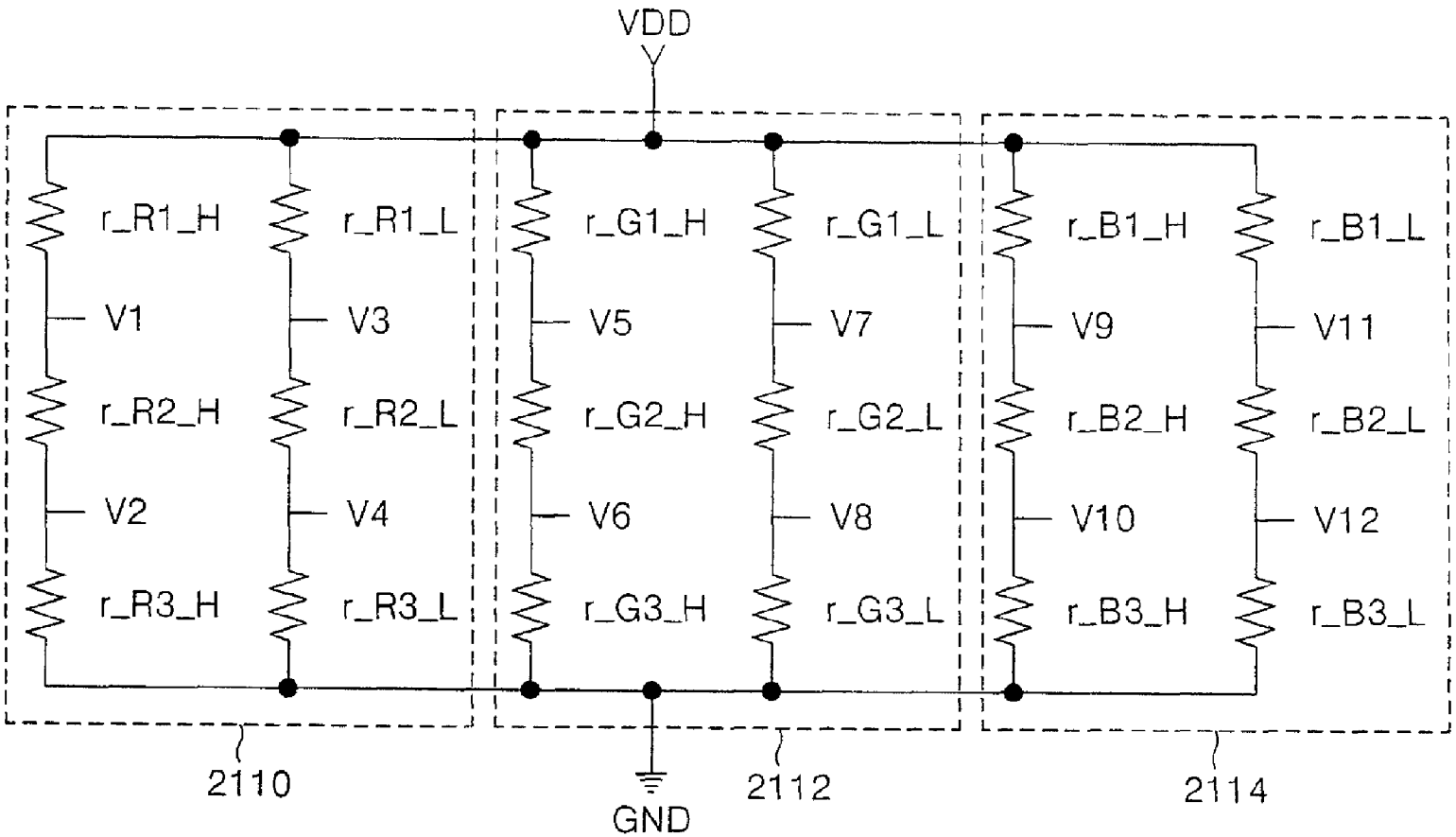
FIG. 16 is a circuit diagram illustrating still another embodiment of the gamma generation voltage supplier.

FIG. 16 shows still another embodiment of a gamma generation voltage supplier 172.

Referring to FIG. 16, the gamma generation voltage supplier 172 supplies a plurality of gamma generation voltages to the data driver 164 in order that the reference gamma voltage is generated in the data driver 164. The gamma generation voltage supplier 172 includes the R gamma generation voltage part 2110, the G gamma generation voltage part 2112 and the B gamma generation voltage part 2114 in order that a different reference gamma voltage is generated by R cell, G cell, B cell. Herein, each of the gamma generation voltage part 2110, 2112, 2114 is composed of a plurality of divided voltage resistors to divide the voltage of the supply voltage source VDD.

The R gamma generation voltage part 2110 supplies a first gamma generation voltage V1 and a second gamma generation voltage V2 to the data driver 164 for the R reference gamma voltage VH_R of low gray level to be generated, and in addition supplies a third gamma generation voltage V3 and a fourth gamma generation voltage V4 to the data driver 164 for the R reference gamma voltage VL_R of high gray level to be generated. Herein, the third gamma generation voltage V3 and the fourth gamma generation voltage V4 have a lower voltage value than the first gamma generation voltage V1.

The G gamma generation voltage part 2112 supplies a fifth gamma generation voltage V5 and a sixth gamma generation voltage V6 to the data driver 164 for the G reference gamma voltage VH_G of low gray level to be generated, and in addition supplies a seventh gamma generation voltage V7 and a eighth gamma generation voltage V8 to the data driver 164 for the G reference gamma voltage VL_G of high gray level to be generated. Herein, the seventh gamma generation voltage V7 and the eighth gamma generation voltage V8 have a lower voltage value than the fifth gamma generation voltage V5.

The B gamma generation voltage part 2114 supplies a ninth gamma generation voltage V9 and a tenth gamma generation voltage V10 to the data driver 164 for the B reference gamma voltage VH_B of low gray level to be generated, and in addition supplies a eleventh gamma generation voltage V11 and a twelfth gamma generation voltage V12 to the data driver 164 for the B reference gamma voltage VL_B of high gray level to be generated. Herein, the eleventh gamma generation voltage V11 and the twelfth gamma generation voltage V12 have a lower voltage value than the ninth gamma generation voltage V9.

Figure 17A:
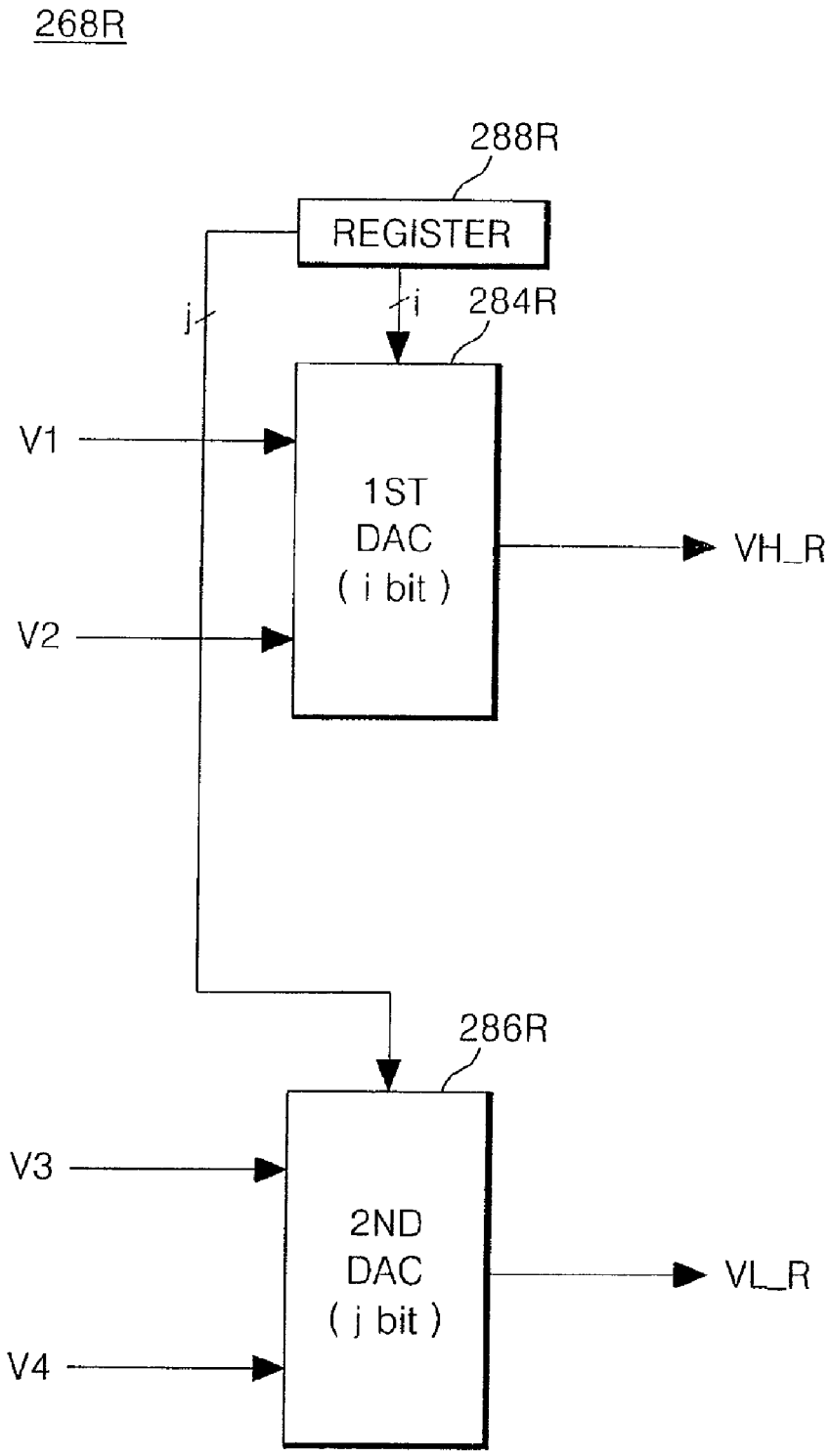
FIGS. 17A to 17C are circuit diagrams illustrating still another embodiment of the reference gamma generator.
Figure 17B:
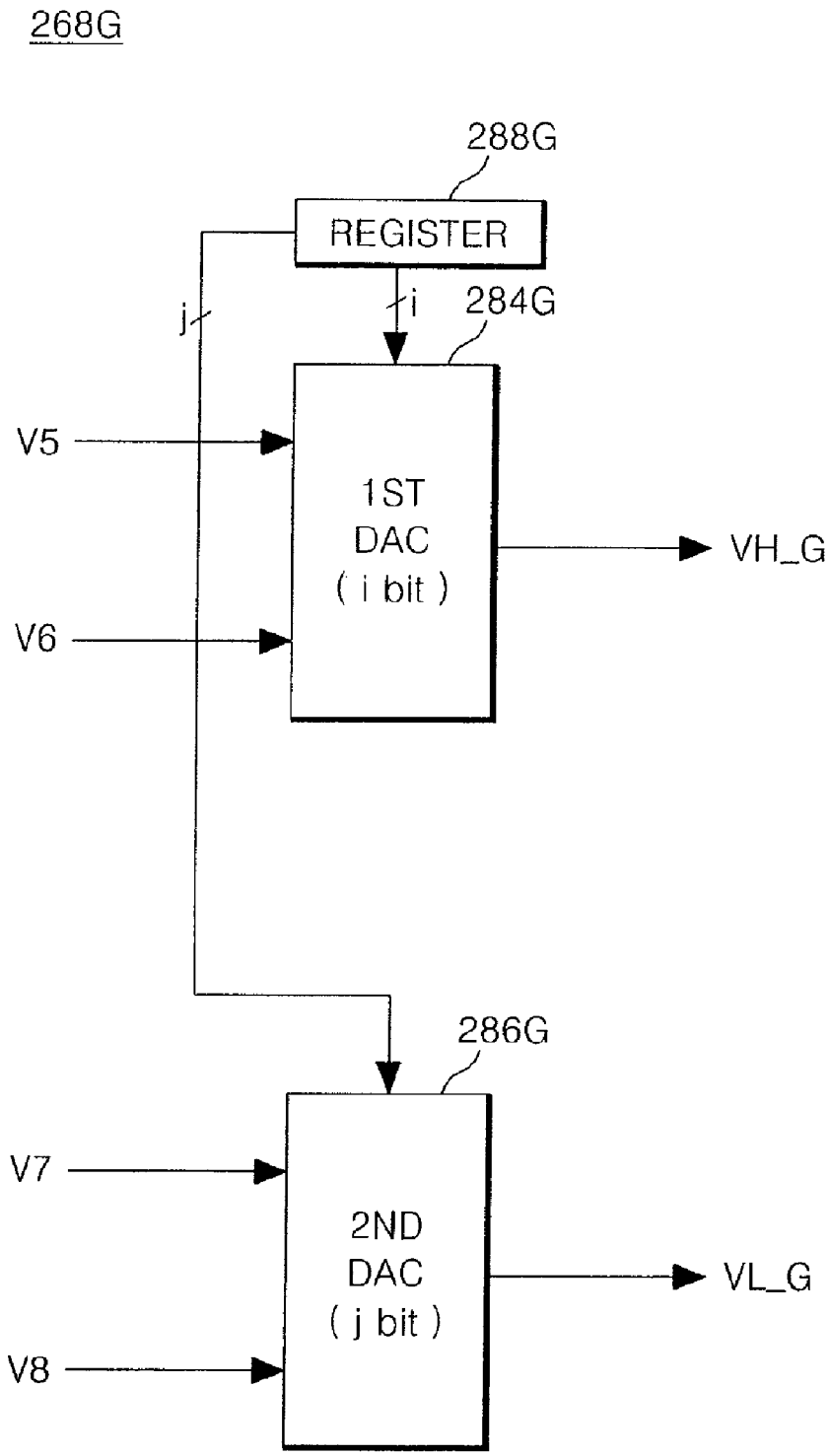
Figure 17C:
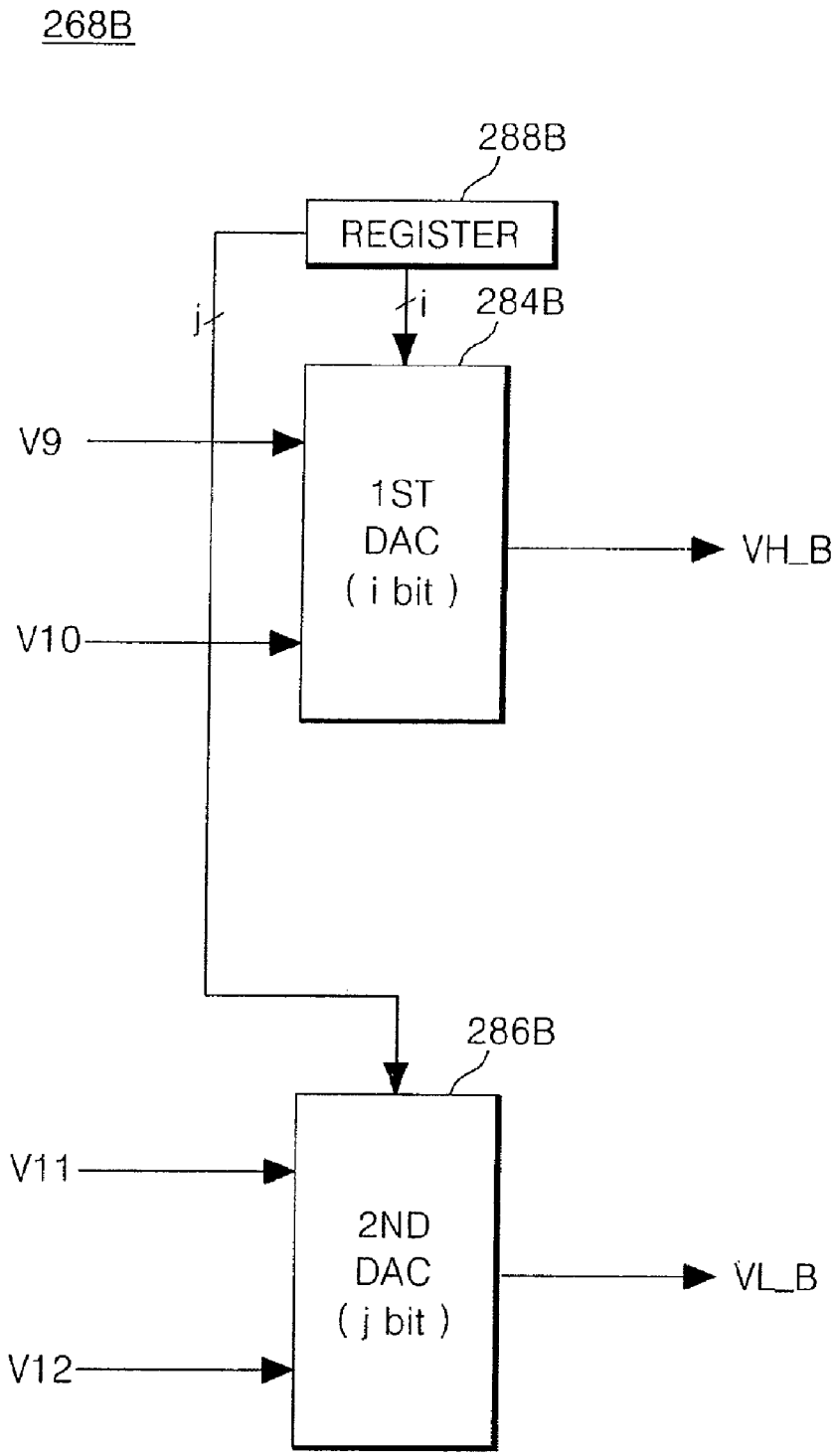
Figure 18:
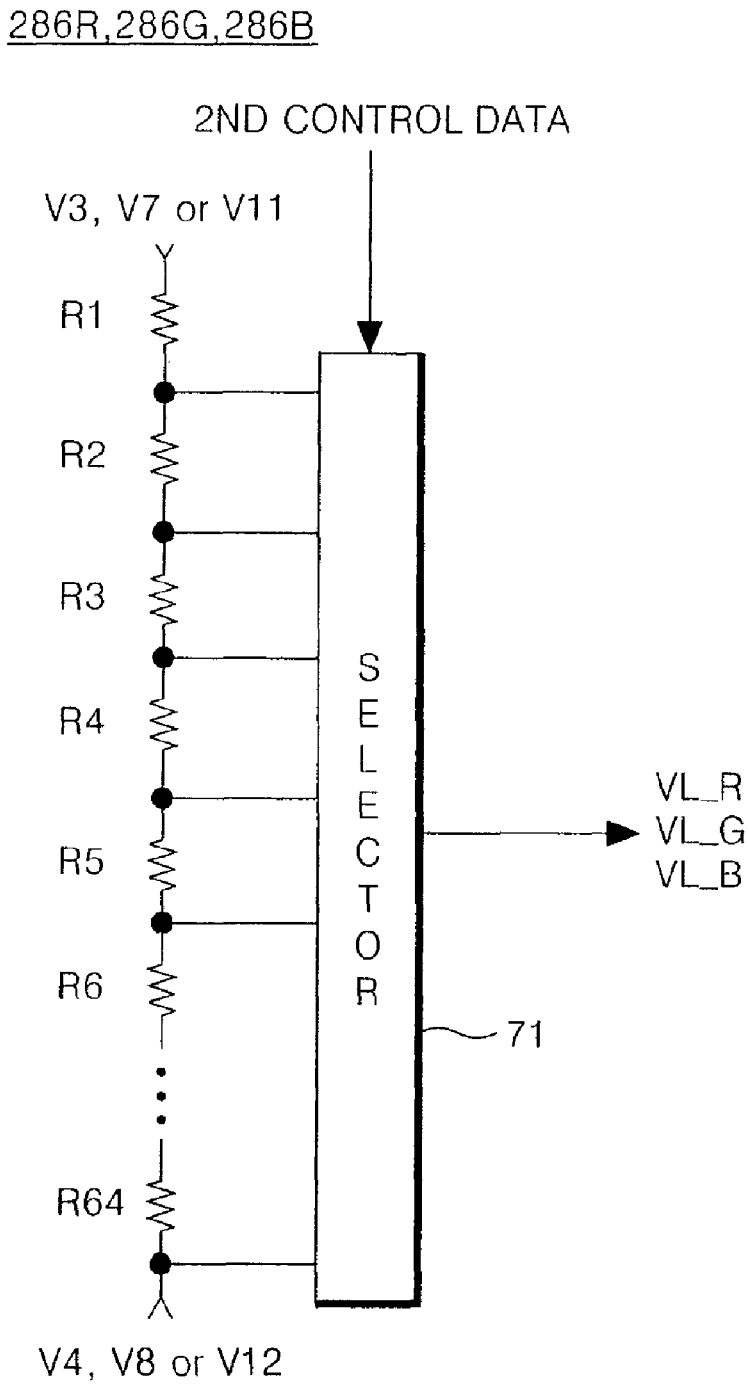
FIG. 18 is a circuit diagram illustrating in detail a second DAC of FIGS. 17A to 17C.

A second embodiment of a reference gamma generator 1100 shown in FIG. 10 is the same as in FIGS. 17A to 17C.

The reference gamma generator 1100 includes an R reference gamma generator 268R, a G reference gamma generator 268G and a B reference gamma generator 268B.

The R reference gamma generator 268R generates the R reference gamma voltage VH_R of low gray level in use of the first gamma generation voltage V1 and the second gamma generation voltage V2, and generates the R reference gamma voltage VL_R of high gray level in use of the third gamma generation voltage V3 and the fourth gamma generation voltage V4.

The G reference gamma generator 268G generates the G reference gamma voltage VH_G of low gray level in use of the fifth gamma generation voltage V5 and the sixth gamma generation voltage V6, and generates the G reference gamma voltage VL_G of high gray level in use of the seventh gamma generation voltage V7 and the eight gamma generation voltage V8.

The B reference gamma generator 268B generates the B reference gamma voltage VH_B of low gray level in use of the ninth gamma generation voltage V9 and the tenth gamma generation voltage V10, and generates the B reference gamma voltage VL_B of high gray level in use of the eleventh gamma generation voltage V11 and the twelfth gamma generation voltage V12.

The R reference gamma generator 268R, the G reference gamma generator 268G and the B reference gamma generator 268B substantially the same circuit composition, thus putting focus on the R reference gamma generator 268R, the operation of the reference gamma generators 268R, 268G and 268B is described.

The R reference gamma generator 268R includes a first DAC 284R, a second DAC 286R and a register 288R as in FIG. 17A. The first DAC 284R divides the first gamma generation voltage V1 and the second gamma generation voltage V2 supplied from the gamma generation voltage supplier 172, into a plurality of voltage levels.

The first DAC 284R divides the first gamma generation voltage V1 and the second gamma generation voltage V2 into $2^i$ (i is a natural number) numbers of voltage levels. And, the first DAC 284R supplies any one voltage among the $2^i$ numbers of voltages to the data integrated circuits 166, as the R reference gamma voltage VH_R of low gray level, in correspondence to the first control data of i bit supplied from the register 288.

The second DAC 286R divides the third gamma generation voltage V3 and the fourth gamma generation voltage V4 supplied from the gamma generation voltage supplier 272, into $2^j$ (j>i, j is a natural number) of voltage levels. And the second DAC 268R supplies any one voltage among the $2^j$ numbers of voltages to the data integrated circuits 166, as the R reference gamma voltage VL_R of high gray level, in correspondence to the first control data of j bit supplied from the register 288.

Likewise, the second DAC 286R divides the gamma reference voltage into the voltage levels that are more than those of the first DAC 284R. In other words, the second DAC 286R has the $2^j$ numbers of voltage levels and the first DAC 284R has the $2^i$ numbers of voltage levels which is smaller than that. In this way, if the second DAC 286R has more voltage levels, the R reference gamma voltage VL_R of high gray level can be controlled precisely, thus the brightness deviation between the display panels 60 can be precisely controlled in the high gray level where the gray level difference is easily perceived with bare eyes.

The first control data of i bit is stored at the register 288R to control the output of the first DAC 284R. And the second control data of j bit is stored at the register 288R to control the output of the second DAC 286R. Herein, the bit value of the first and second control data inputted to the register 288R is determined by a user. For example, the first and second control data, which can compensate the brightness deviation generated between the EL display panels 160, is stored at the register 288R.

The G reference gamma generator 268G of FIG. 7B generates the G reference gamma voltage VH_G of low gray level and the G reference gamma voltage VL_G of high gray level in use of the fifth to eighth gamma generation voltage (V5 to V8). And, the B reference gamma generator 268B as in FIG. 7C generates the B reference gamma voltage VH_B of low gray level and the B reference gamma voltage VL_B of high gray level in use of the ninth to twelfth gamma generation voltage V9 to V12.

This invention might control the reference gamma voltage precisely in use of the control data stored at the registers 288R, 288G, 288B, thus the brightness of the display panel 60 might be controlled minutely. Accordingly, this invention can deal with the brightness deviation between the display panels actively, thus its process time might be shortened.

On the other hand, if the bit number of the control data stored at the second DAC's 286R, 286G, 286B is big, there is a problem that the size of the second DAC's 286R, 286G, 286B is big. For example, the second DAC's 286R, 286G, 286B includes 64 numbers of resistors R1 to R64 as in FIG. 18 to generate sixty four different voltages, as well as includes a selector 71 to output any one voltage among the sixty four voltage levels in correspondence to the second control data.

If each of the second DAC's 286R, 286G, 286B includes the sixty four resistors R1 to R64 and the selector 71 which is to output any one voltage among the sixty four voltages, the size of the second DAC 286R, 286G, 286B becomes bigger, thus its circuit cost gets bigger as much and it becomes difficult to secure the degree of freedom for design. Especially, such problems are to be shown in a bigger scale when the second DAC's 286R, 286G, 286B are integrated in the inside of the data integrated circuit 266.

Figure 19A:
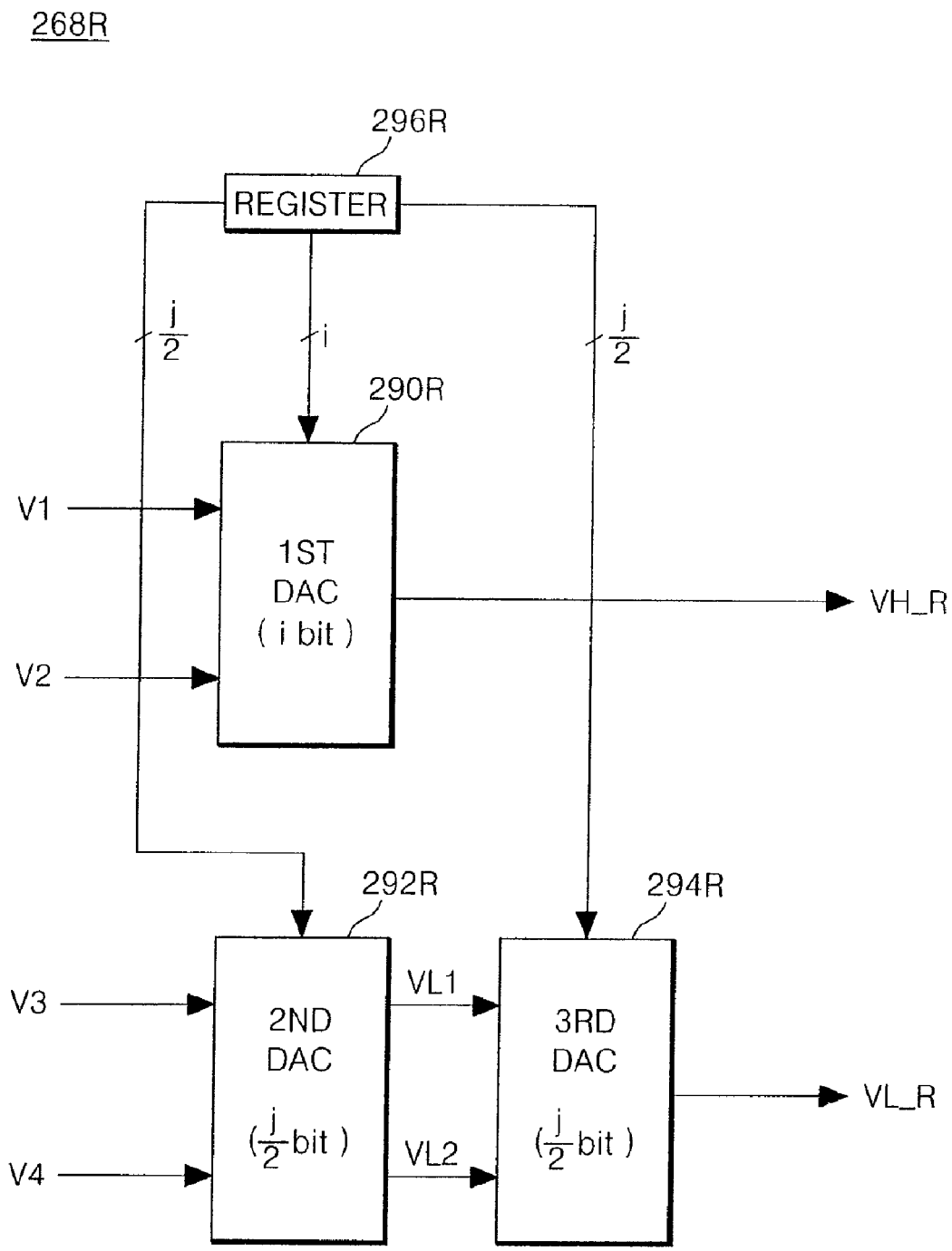
FIGS. 19A to 19C are circuit diagrams illustrating another embodiment of the second DAC.
Figure 19B:
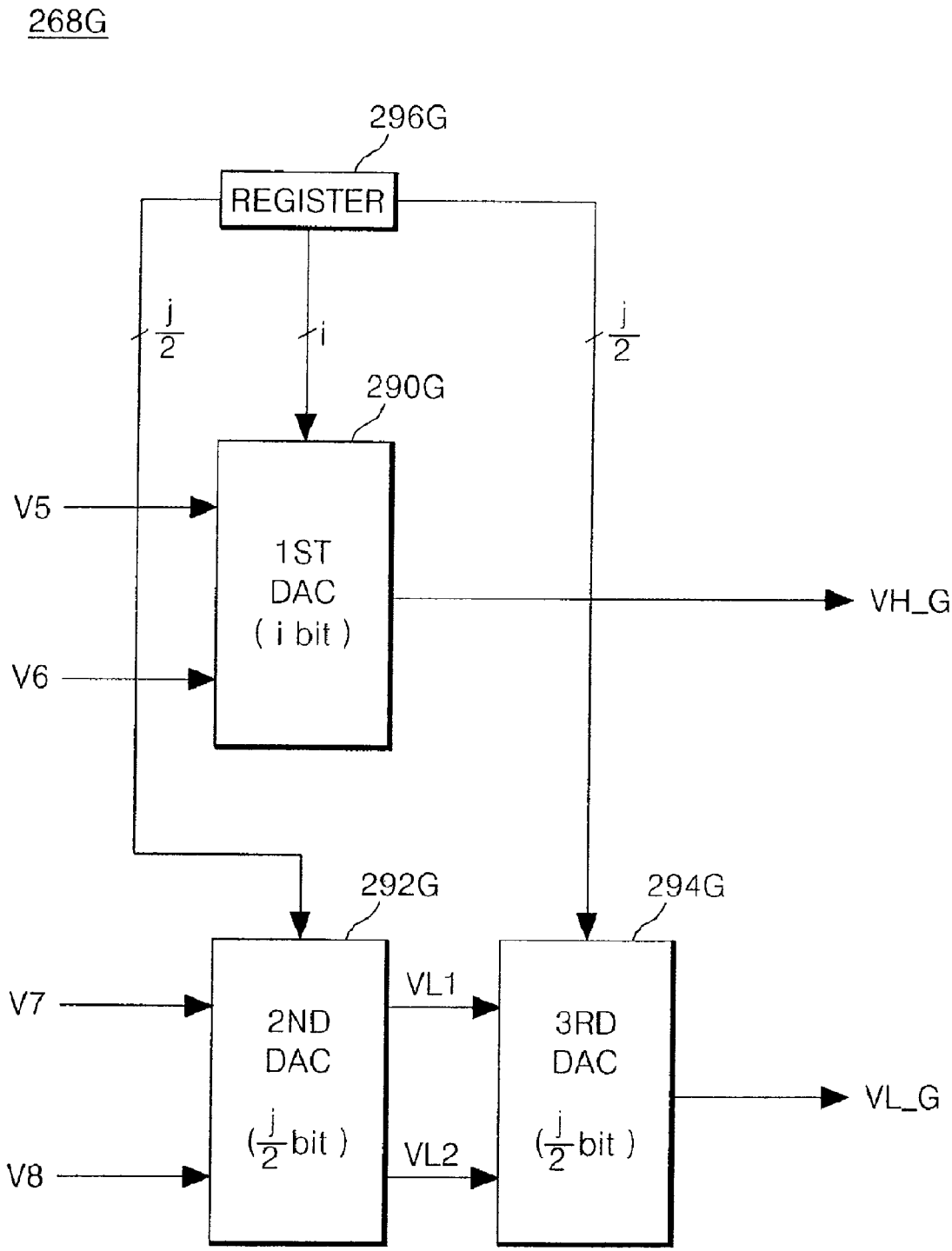
Figure 19C:
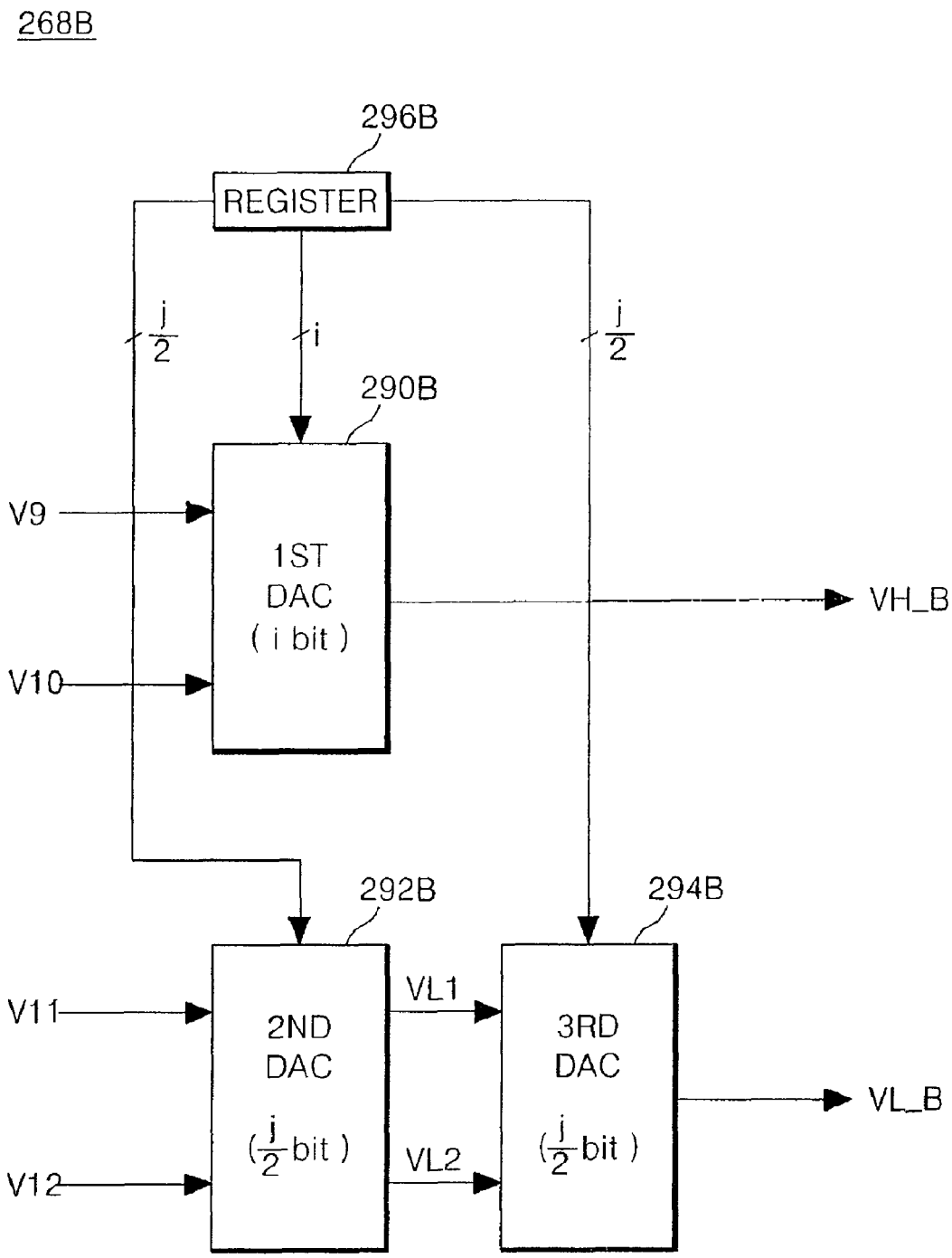
Figure 20:
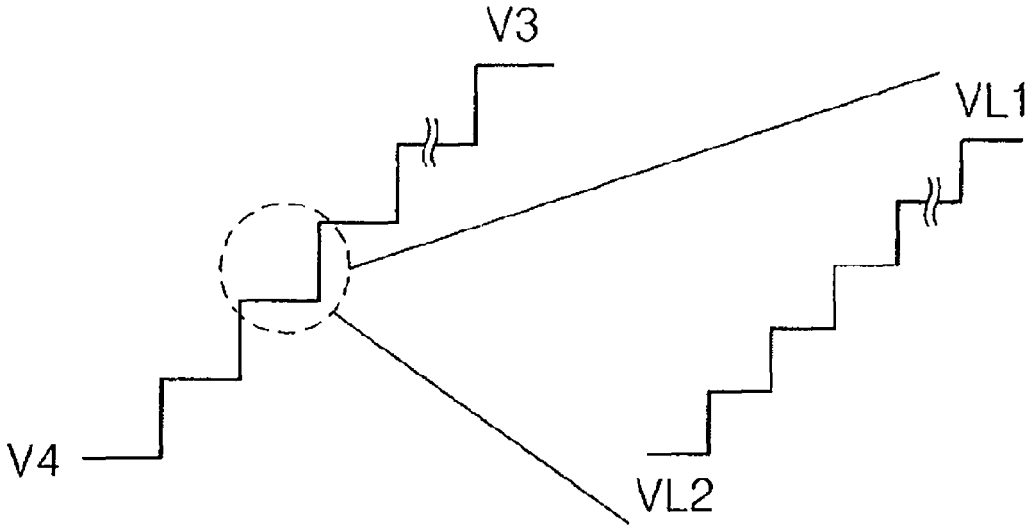
FIG. 20 is a diagram for explaining the operation of the second and third DAC's.

In order to overcome such problems, the reference gamma generator 1100 includes the R reference gamma generator 268R, the G reference gamma generator 268G and the B reference gamma generator 268B, which are composed as in FIGS. 19A to 19C. The R reference gamma generator 268R, the G reference gamma generator 268G and the B reference gamma generator 268B substantially have the same circuit composition, thus putting focus on the R reference gamma generator 268R, the operation of the reference gamma generators 268R, 268G and 268B is described.

The R reference gamma generator 268R includes a first DAC 290R, a second DAC 292R and a register 294R as in FIG. 19A.

The first DAC 290R divides the first gamma generation voltage V1 and the second gamma generation voltage V2 supplied from the gamma generation voltage supplier 172, into a plurality of voltage levels. For example, the first DAC 290R divides the first gamma generation voltage V1 and the second gamma generation voltage V2 into $2^i$ numbers of voltage levels. And the first DAC 290R supplies any one voltage among a number of voltages to the data integrated circuits 166, as the R reference gamma voltage VH_R of low gray level, in correspondence to the bit of the first control data supplied from the register 296R.

The second DAC 292R divides the third gamma generation voltage V3 and the fourth gamma generation voltage V4 supplied from the gamma generation voltage supplier 172, into a plurality of voltage levels. For example, the second DAC 292R divides the third gamma generation voltage V3 and the fourth gamma generation voltage V4 into $2^j/2$ numbers of voltage levels so that it can be selected by the control data of j/2 (j>i, j/2<i: e.g., j/2 is set to be '3'). And the second DAC 292R supplies the adjacent first divided voltage VL1 and second divided voltage VL2 among a plurality of voltages to the third DAC 294R, in correspondence to the bit of the second control data supplied from the register 296R. For example, the second DAC 292R divides the third gamma generation voltage V3 and the fourth gamma generation voltage V4 into voltages of eight steps as in FIG. 20, and the adjacent voltages among the divided voltages, as the first divided voltage VL1 and the second divided voltage VL2, are supplied to the third DAC 294R, in correspondence to the second control data. And then, the third DAC 294R divides the first divided voltage VL1 and the second divided voltage VL2 supplied from the second DAC 292R to $2^j/2$ numbers of voltage level (8 voltage levels). And, the third DAC 294R supplies any one voltage among the voltages, as the R reference gamma voltage VL_R of high gray level, to the data integrated circuits, in correspondence to the bit of the third control data.

In this way, the present invention has its size reduced by more than ½ and secures more degree of freedom for design, when compared with the embodiment of FIGS. 17A to 17C, in use of the second and third DAC 92, 94 where the output voltage can be selected by the j/2 bit. For example, assuming that j is 6 bit, each of the second DAC 292R and the third DAC 294R includes eight resistors. Accordingly, the number of resistors thereof is reduced greatly than that of the sixty four resistors included in the second DAC 286R shown in FIG. 17A, and accordingly the size gets smaller.

The first control data of i bit is stored in the register 296R to control the output value of the first DAC 290R. And the second and third control data of j/2 bit are stored at the register 296R to control the output of the second DAC 292R and the third DAC 294R. Herein, the bit value of the first to third control data having been inputted in the register 296R is set to compensate the brightness deviation generated between the EL display panel 160.

The G reference gamma generator 268G of FIG. 19B generates the G reference gamma voltage VH_G of low gray level and the G reference gamma voltage VL_G of high gray level in use of the fifth to eighth gamma generation voltage V5 to V8. And, the B reference gamma generator 268B of FIG. 19C generates the B reference gamma voltage VH_B of low gray level and the B reference gamma voltage VL_B of high gray level in use of the ninth to twelfth gamma generation voltage V9 to V12.

Figure 21:
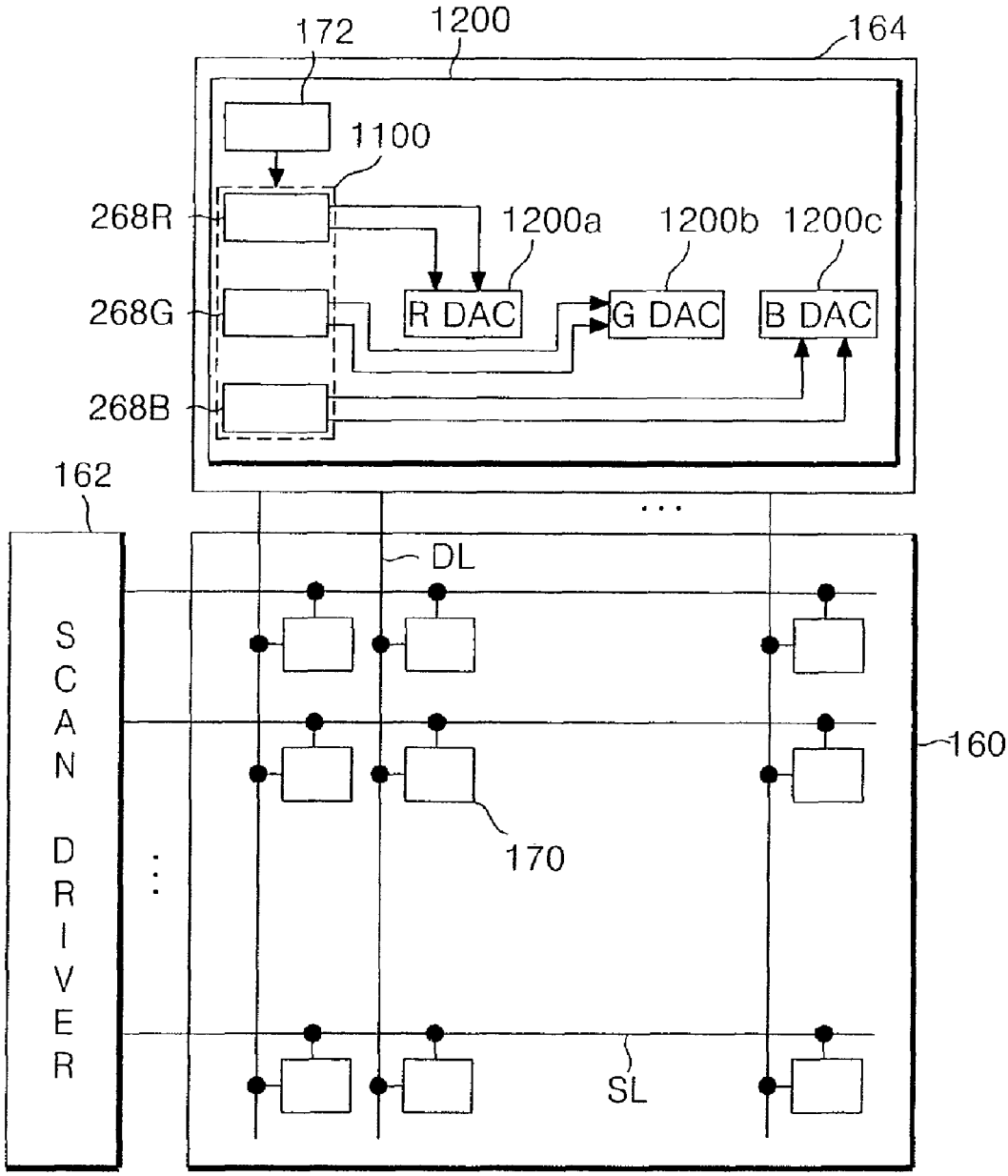
FIG. 21 is a diagram illustrating an example that the gamma generation voltage supplier together with the reference gamma generator is built in the data integrated circuit.

The reference gamma generator 1100 included in the reference gamma generators 268R, 268G, 268B might be integrated in the inside of the data integrated circuit 1200 as in FIG. 15. Further, the gamma generation voltage supplier 172 along with the reference gamma generator 1100 might be integrated in the inside of the data integrated circuit 1200 as in FIG. 21. In FIG. 21, the reference numerals "1200A", "1200B", "1200B" represent the R DAC, the G DAC and the B DAC, respectively.

Figure 22:
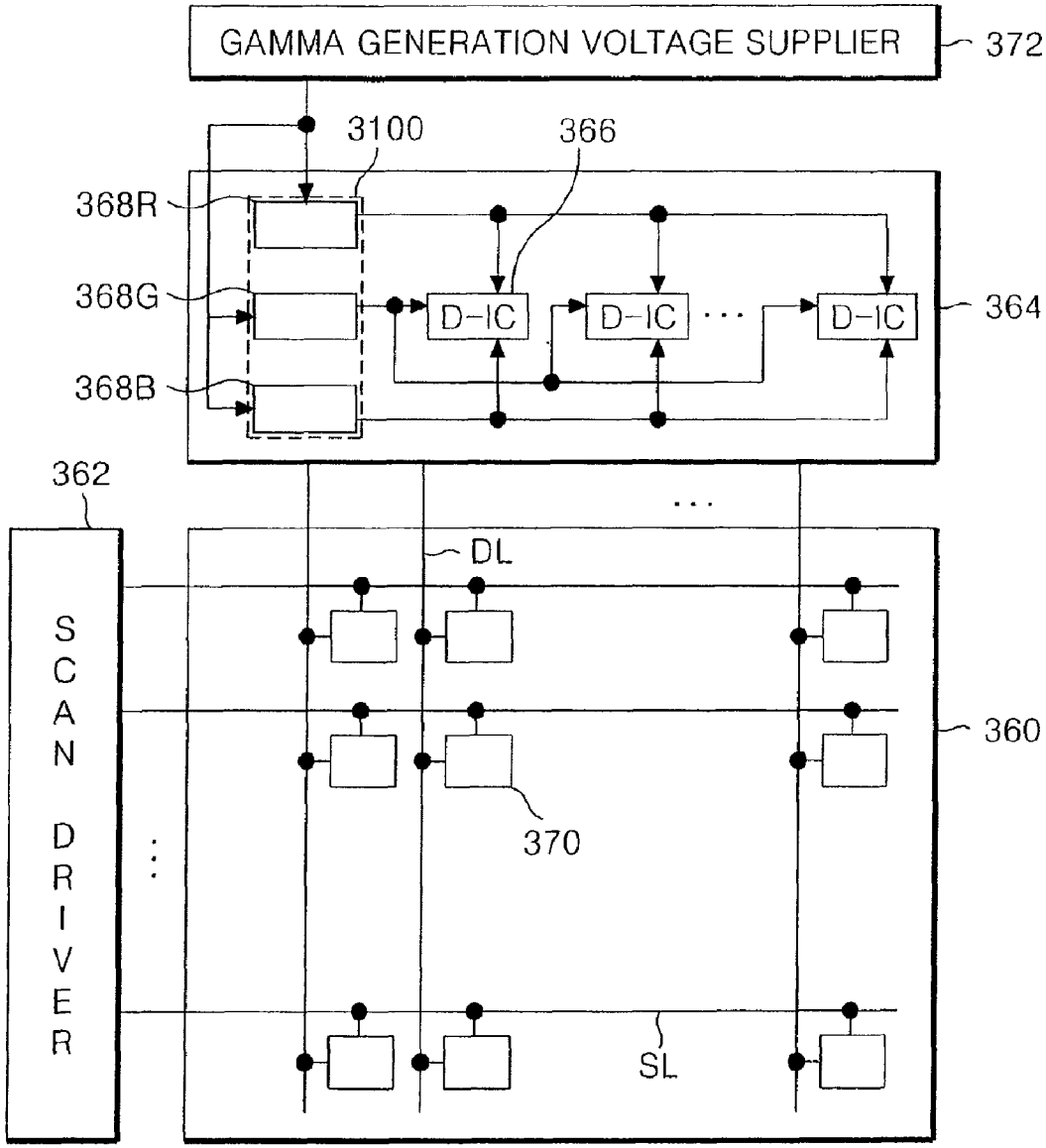
FIG. 22 is a diagram illustrating an electro-luminescence display device according to a fourth embodiment of the present invention.
Figure 23:
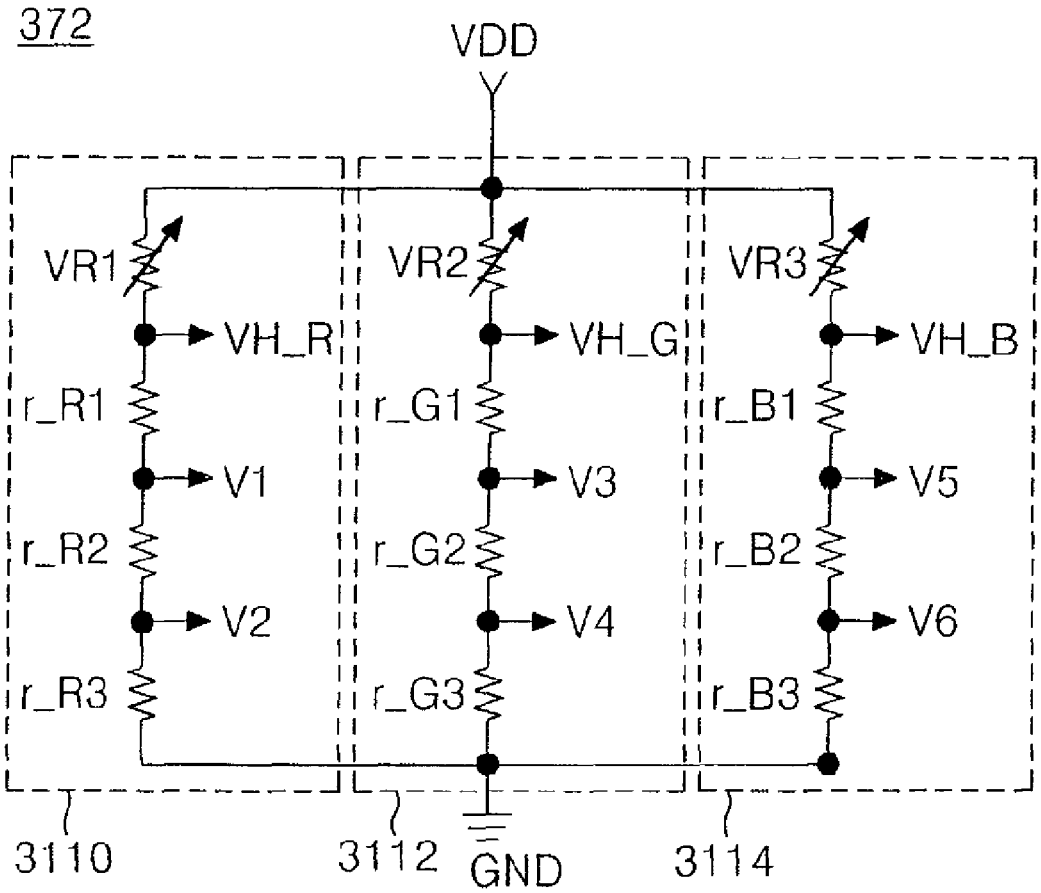
FIG. 23 is a circuit diagram illustrating in detail a gamma generation voltage supplier shown in FIG. 22.

FIG. 22 represents an EL display device according to still another embodiment of the present invention.

Referring to FIG. 22, the EL display device according to the embodiment of the present invention includes an EL display panel 360 having EL cells 370 arranged at each intersection of scan electrode lines SL and data electrode lines DL, a scan driver 362 to drive the scan electrode lines SL, a data driver 364 to drive the data electrode lines DL, and a gamma generation voltage supplier 372 to generate gamma generation voltages.

The gamma generation voltage supplier 372 generates the reference gamma voltages VH_R, VH_G, VH_B of low gray level to supply them to the data integrated circuits 366. And, the gamma generation voltage supplier 372 supplies a plurality of gamma generation voltages to a reference gamma generator 3100 included in the data driver 364 so that the reference gamma voltages VL_R, VL_G, VL_B of high gray level are generated. The gamma generation voltage supplier 372 includes an R gamma generation voltage part 3110, a G gamma generation voltage part 3112, a B gamma generation voltage part 3114 as in FIG. 23, so that different reference gamma voltages VH_R, VH_G, VH_B and the gamma generation voltage can be generated by R cell, G cell, B cell.

The R gamma generation voltage part 3110 includes a first variable resistor VR1 to generate the reference gamma voltage VH_R of low gray level, and divided voltage resistors r_R1, r_R2, r_R3 to generate the first and second gamma generation voltages V1 and V2 by dividing the reference gamma voltage VH_R of low gray level. Herein, the reference gamma voltage VH_R of low gray level is supplied to the data integrated circuit 366 and the first and second gamma generation voltage V1, V2 are supplied to the reference gamma generator 3100.

The G gamma generation voltage part 3112 includes a second variable resistor VR2 to generate the reference gamma voltage VH_G of low gray level, and divided voltage resistors r_G1, r_, r_G3 to generate the third and fourth gamma generation voltages V3 and V4 by dividing the reference gamma voltage VH_G of low gray level. Herein, the reference gamma voltage VH_G of low gray level is supplied to the data integrated circuit 366 and the third and fourth gamma generation voltage V3, V4 are supplied to the reference gamma generator 3100.

The B gamma generation voltage part 3114 includes a third variable resistor VR3 to generate the reference gamma voltage VH_B of low gray level, and divided voltage resistors r_B1, r_B2, r_B3 to generate the fifth and sixth gamma generation voltages V5 and V6 by dividing the reference gamma voltage VH_B of low gray level. Herein, the reference gamma voltage VH_B of low gray level is supplied to the data integrated circuit 366 and the fifth and sixth gamma generation voltage V5, V6 are supplied to the reference gamma generator 3100.

The data driver 364 includes the reference gamma generator 3100 and at least one data integrated circuit 366. The data integrated circuit 366 is composed as in FIG. 4, and divides the reference gamma voltages supplied from the gamma generation voltage supplier 372 and the reference gamma generator 3100 into a plurality of voltage levels to generate a data signal, thereby supplying the data signal to the data electrode lines DL.

The reference gamma generator 3100 generates the reference gamma voltages of high gray level in use of the gamma generation voltages supplied from the gamma generation voltage supplier 372. For this, the reference gamma generator 3100 includes the R reference gamma generator 368R, the G reference gamma generator 368G, the B reference gamma generator 368B.

The R reference gamma generator 368R generates the reference gamma voltage VL_R of high gray level in use of the first gamma generation voltage V1 and the second gamma generation voltage V2. The G reference gamma generator 368G generates the reference gamma voltage VL_G of high gray level in use of the third gamma generation voltage V3 and the fourth gamma generation voltage V4. The B reference gamma generator 368B generates the reference gamma voltage VL_B of high gray level in use of the fifth gamma generation voltage V5 and the sixth gamma generation voltage V6. Herein, the R reference gamma generator 368R, the G reference gamma generator 368G and the B reference gamma generator 368B substantially have the same circuit composition, thus putting focus on the R reference gamma generator 368R, the operation of the reference gamma generators 368R, 368G and 368B is described.

Figure 24A:
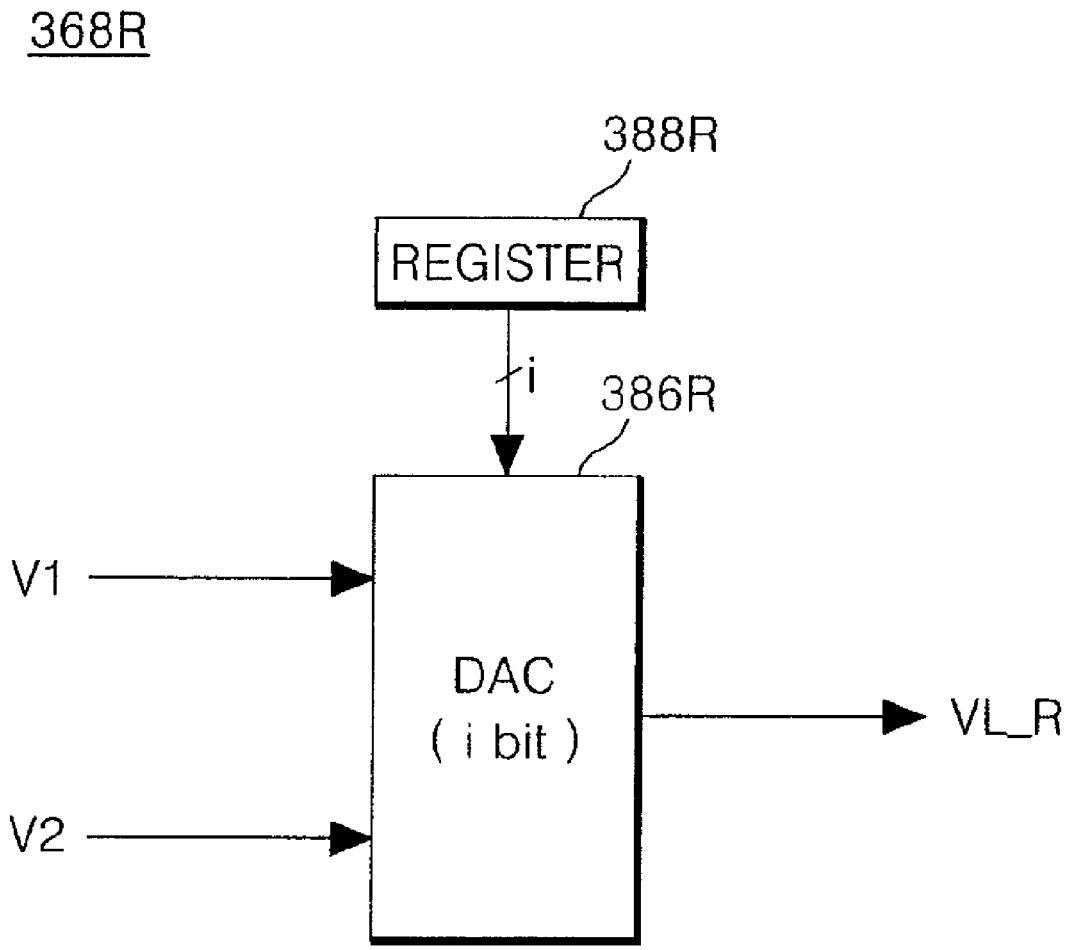
FIGS. 24A to 24C are diagrams illustrating in detail a reference gamma generator shown in FIG. 22.

The R reference gamma generator 368R includes a DAC 386R and a register 388R as in FIG. 24A. The DAC 386R divides the first gamma generation voltage V1 and the second gamma generation voltage V2 supplied from the gamma generation voltage supplier 372 into a plurality of voltage levels. For example, the DAC 386R is composed of i bit (i is a natural number), and divides the first gamma generation voltage V1 and the second gamma generation voltage V2 into $2^i$ numbers of voltage levels. And the DAC 386R supplies any one voltage among the $2^i$ numbers of voltage levels, as the reference gamma voltage VL_R of high gray level, to the data integrated circuits 366, in correspondence to the control data supplied from the register 388R.

In this embodiment, the reference gamma voltage VH controls the voltage value in use of the variable resistors VR1, VR2 and VR3, and controls the voltage value in use of the reference gamma voltage VL of high gray level. If the reference gamma voltage VL of high gray level in this way is precisely adjusted by the DAC 386R, then the brightness deviation between the display panels 360 is minimized.

The control data of i bit is stored at the register 388R to control the output value of the DAC 386R. Herein, the bit value of the control data inputted into the register 388R is determined by a user. For example, the register 388R might store the control data where a bit value is set to compensate the brightness deviation generated between the display panels 360. When there is a brightness deviation between the EL display panels 60, the user controls the brightness of low gray level in use of the variable resistance value of the first to third variable resistors VR1 to VR3, and controls the bit value of the control data, thereby enabling to compensate the brightness deviation between the display panels 360. Further, the input terminal of the register 388R has a mode controller (not shown) installed, and the register 388R controls the output value of the DAC 386R by receiving the control data from the mode controller, thus it is possible to control to display a picture of an appropriate brightness that corresponds to an external environment, i.e., day, night, rain, snow and etc.

Figure 24B:
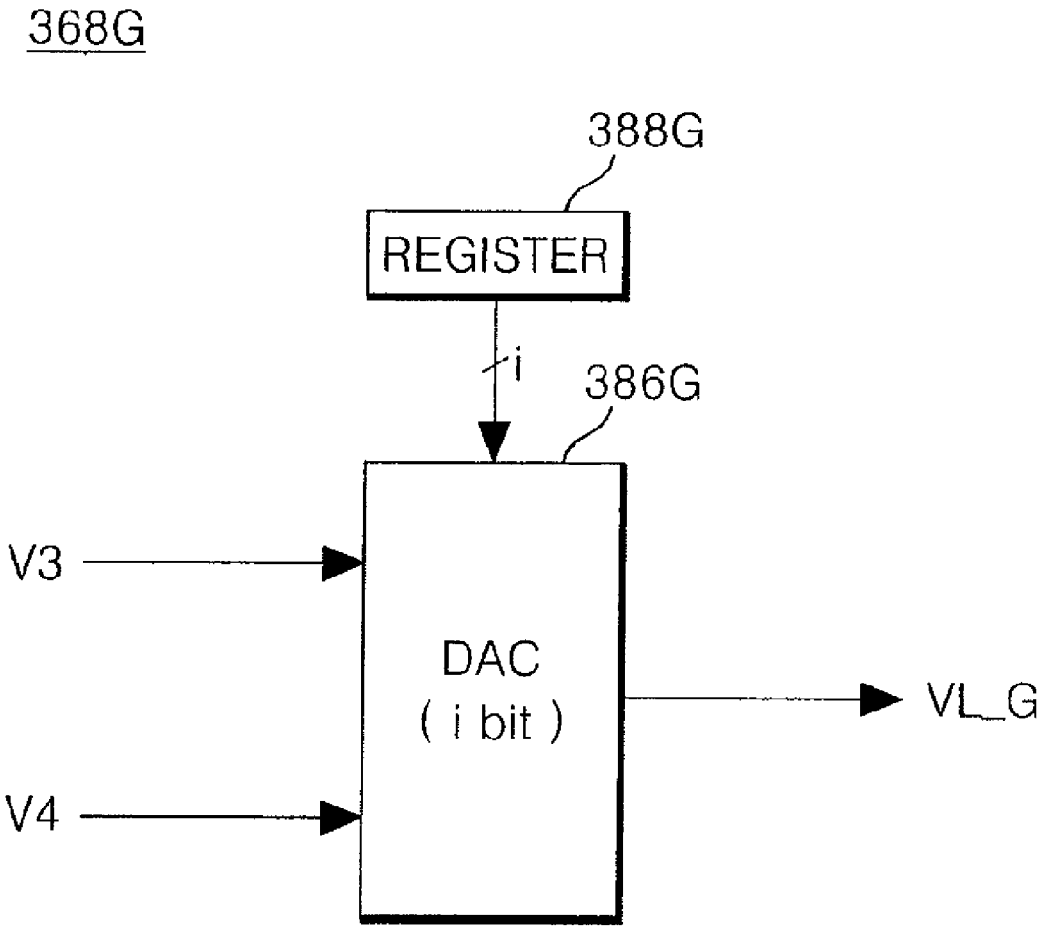
Figure 24C:
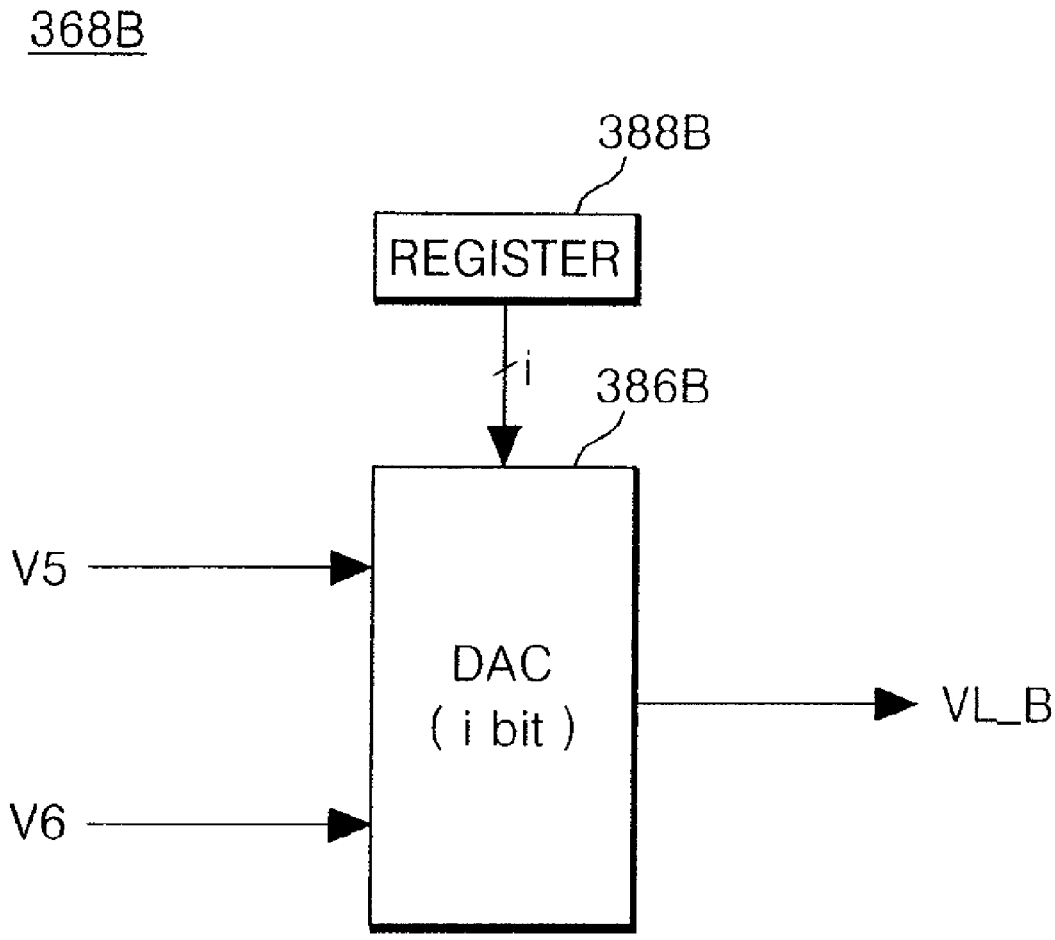

In this invention, the G reference gamma generator 368G and the B reference gamma generator 368B are composed as in FIGS. 24B and 24C. The G reference gamma generator 368G generates the reference gamma voltage VL_G of high gray level in use of the third and fourth gamma generation voltage V3, V4. And the B reference gamma generator 368B generates the reference gamma voltage VL_B of high gray level in use of the fifth and sixth gamma generation voltage V5, V6. In FIGS. 24B and 24C, the reference numerals "386G" and "386B" represent the DAC, and "388G" and "388B" represent the register.

Figure 25:
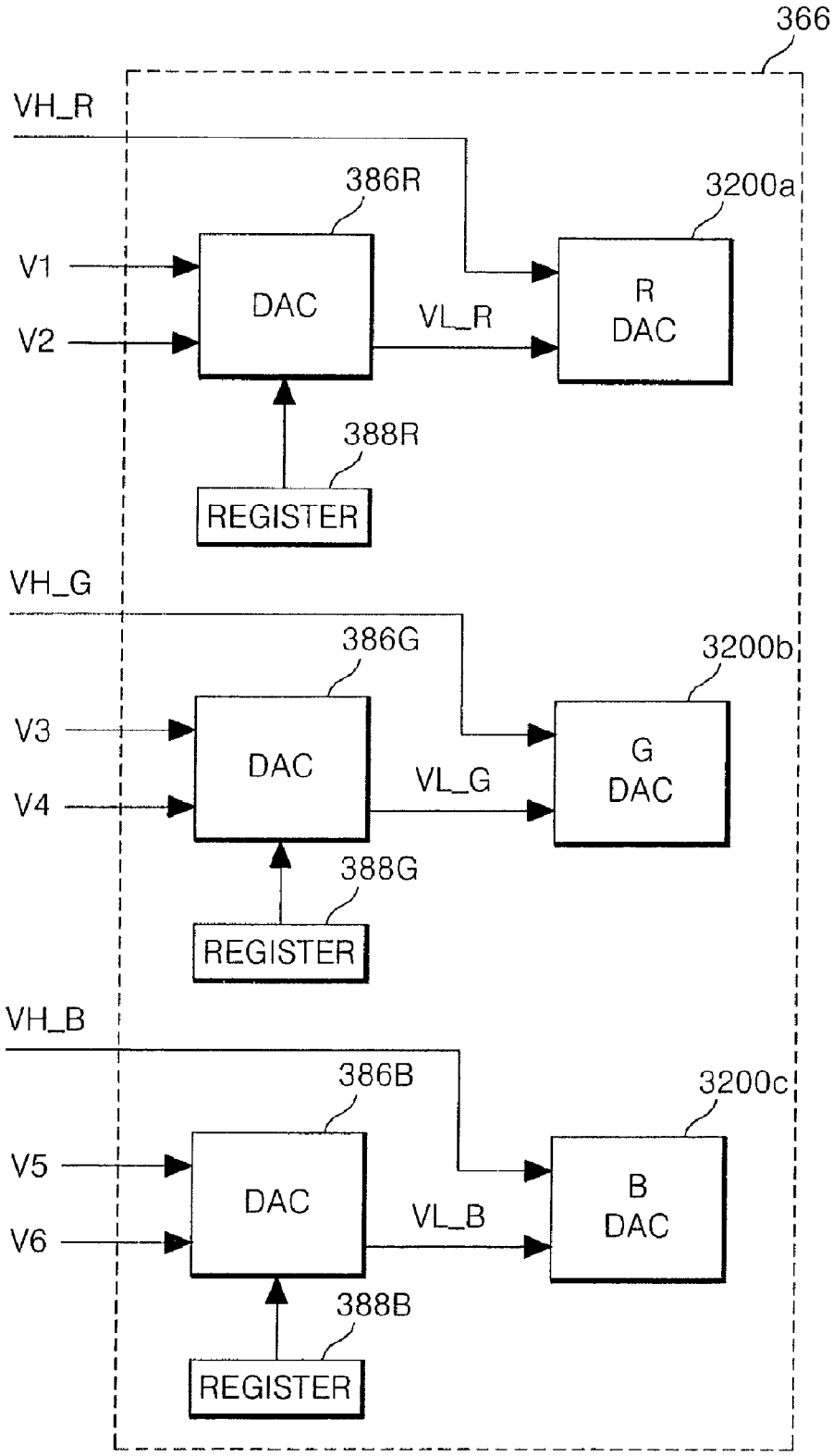
FIG. 25 is a diagram illustrating a circuit where the reference gamma generator shown in FIG. 22 is built in an integrated circuit.

In this invention, the circuits of the reference gamma generator might be integrated in the inside of the data integrated circuit 366 as in FIG. 25. In FIG. 25, the reference numerals "3200A", "3200B" and "3200C" represent the DAC.

As described above, according to the electro-luminescence display device of the present invention, the reference gamma voltage can be adjusted in use of the control data stored at the register, thus the expression capability of gray level is improved, the brightness deviation between the display panels might be compensated in a short time, and the gamma adjustment time and the process time might be reduced. In addition, the present invention might compensate the brightness deviation exactly because the reference gamma voltage is selected as any one of voltage levels. Further, the gamma voltage generator in this invention is mounted on the COF, thus FPC might be removed, and the number of resistors mounted on the FPC is reduced to decrease the area of the FPC, thereby enabling to secure its design margin broadly. In addition, the invention has the align time of the COF and FPC shortened so that it is possible to obtain an additional effect that its process time might be reduced.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display device, comprising:

a red reference gamma generator, a green reference gamma generator and a blue reference gamma generator each having three digital analog converters or more in order to generate a reference gamma voltage of low gray level and a reference gamma voltage of high gray level; and at least one integrated circuit to generate a data signal in use of the reference gamma voltage of low gray level and the reference gamma voltage of high gray level, wherein each of the red, green and blue reference gamma generators includes:

a first digital analog converter to divide a voltage supplied to itself in order to generate i (i is a natural number) numbers of voltage levels;

a second digital analog converter to divide a voltage supplied to itself in order to generate j (j is a smaller natural number than i) numbers of voltage levels; and a third digital analog converter to receive two voltage levels from the second digital analog converter and to divides the two received voltage levels into j numbers of voltage levels.

2. The electro-luminescence display device according to claim 1, wherein the first digital analog converter selects any one voltage among the i numbers of voltage levels, as the reference gamma voltage of low gray level, to supply the selected voltage to the integrated circuit.

3. The electro-luminescence display device according to claim 1, wherein the third digital analog converter selects any one voltage among the j numbers of voltage levels generated by itself, as the reference gamma voltage of high gray level, and to supply the selected voltage to the integrated circuit.

4. The electro-luminescence display device according to claim 1, wherein the second digital analog converter supplies two voltage levels adjacent to each other among the j numbers of voltage levels generated by itself, to the third digital analog converter.

5. The electro-luminescence display device according to claim 1, wherein each of the red, green and blue reference gamma generation parts further includes a register storing control data that control the output of the first digital analog converter, the second digital analog converter and the third digital analog converter.

6. The electro-luminescence display device according to claim 5, wherein the control data stored at the register are set to enable the electro-luminescence display devices to display uniform brightness.

7. The electro-luminescence display device according to claim 1, wherein the red reference gamma generator, the green reference gamma generator and the blue reference gamma generator are mounted in the inside of the integrated circuit.

8. An electro-luminescence display device, comprising:

a gamma generation voltage supplier to generate a reference gamma voltage of low gray level and a plurality of gamma generation voltages;

a reference gamma generator to generate a reference gamma voltage of high gray level in use of the gamma generation voltages; and a data integrated circuit to generate a data signal in use of the reference gamma voltage of low gray level and the reference gamma voltage of high gray level, wherein the reference gamma generator includes:

a red reference gamma generator to generate a red reference gamma voltage of high gray level so that the data signal to be supplied to a red cell can be generated;

a green reference gamma generator to generate a green reference gamma voltage of high gray level so that the data signal to be supplied to a green cell can be generated; and a blue reference gamma generator to generate a blue reference gamma voltage of high gray level so that the data signal to be supplied to a blue cell can be generated, wherein each of the red, green and blue reference gamma generators includes:

a digital analog converter to divide the voltages supplied from the gamma generation voltage supplier into a plurality of voltage levels; and a register storing a control data that enables to output any one voltage among the voltage levels voltage-divided at the digital analog converter.

9. The electro-luminescence display device according to claim 8, wherein the gamma generation voltage supplier includes:

a red gamma generation voltage supplier to generate a red reference gamma voltage of low gray level so that the data signal to be supplied to a red cell can be generated;

a green gamma generation voltage supplier to generate a green reference gamma voltage of low gray level so that the data signal to be supplied to a green cell can be generated; and a blue gamma generation voltage supplier to generate a blue reference gamma voltage of low gray level so that the data signal to be supplied to a blue cell can be generated.

10. The electro-luminescence display device according to claim 9, wherein each of the red, green and blue gamma generation voltage supplier includes:

a variable resistor to divide a voltage value of a common voltage source to generate the reference gamma voltage of low gray level; and a plurality of divided voltage resistors to divide the reference gamma voltage of low gray level into two different voltage levels from each other to generate the gamma generation voltages.

11. The electro-luminescence display device according to claim 10, wherein a resistance value of the variable resistor included in each of the red, green and blue gamma generation voltage supplier is set to be differently.

12. The electro-luminescence display device according to claim 8, wherein the control data stored at the register is set to enable the electro-luminescence display device to display uniform brightness.

13. The electro-luminescence display device according to claim 8, wherein the reference gamma generator is mounted in the inside of the data integrated circuit.

* * * * *

Disclaimer

7,978,157 B2—Jung Min Seo et al., Daegu (KP). ELECTRO-LUMINESCENCE DISPLAY. Patent dated July 12, 2011. Disclaimer filed April 21, 2011, by the assignee, LG Display Co., LTD.

The term of this patent shall not extend beyond the expiration date of patent no. 7,978,157.

(*Official Gazette January 10, 2012*)